US009487370B2

(12) United States Patent
Utagawa et al.

(10) Patent No.: US 9,487,370 B2
(45) Date of Patent: Nov. 8, 2016

(54) SHEET MATERIAL CONVEYING DEVICE, IMAGE SCANNING DEVICE, AND IMAGE FORMING APPARATUS

(71) Applicants: Hiroaki Utagawa, Kanagawa (JP); Takanori Ohta, Kanagawa (JP); Takashi Nakano, Kanagawa (JP); Takashi Fukumoto, Kanagawa (JP); Kenji Hayasaka, Kanagawa (JP); Joji Akiyama, Kanagawa (JP); Masataka Fukuchi, Kanagawa (JP)

(72) Inventors: Hiroaki Utagawa, Kanagawa (JP); Takanori Ohta, Kanagawa (JP); Takashi Nakano, Kanagawa (JP); Takashi Fukumoto, Kanagawa (JP); Kenji Hayasaka, Kanagawa (JP); Joji Akiyama, Kanagawa (JP); Masataka Fukuchi, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/461,626

(22) Filed: Aug. 18, 2014

(65) Prior Publication Data

US 2015/0048566 A1 Feb. 19, 2015

(30) Foreign Application Priority Data

Aug. 19, 2013 (JP) ..... 2013-169649

(51) Int. Cl.

| | |
|---|---|
| ***B65H 7/14*** | (2006.01) |
| ***B65H 7/12*** | (2006.01) |
| ***B65H 7/20*** | (2006.01) |

(Continued)

(52) U.S. Cl.

CPC ..... *B65H 7/125* (2013.01); *B65H 1/14* (2013.01); *B65H 3/0684* (2013.01); *B65H 3/5261* (2013.01); *B65H 5/062* (2013.01); *B65H 7/14* (2013.01); *B65H 7/20* (2013.01); *B65H 9/006* (2013.01); *B65H 2404/6111* (2013.01); *B65H 2513/10* (2013.01); *B65H 2513/50* (2013.01); *B65H 2553/30* (2013.01);

(Continued)

(58) Field of Classification Search

CPC ..... B65H 7/00; B65H 7/02; B65H 7/04; B65H 7/06; B65H 7/12; B65H 7/125; B65H 7/14; B65H 7/18; B65H 7/20; B65H 2511/52; B65H 2511/524; B65H 2511/528; B65H 2553/30

See application file for complete search history.

(56) References Cited

U.S. PATENT DOCUMENTS

| | | | |
|---|---|---|---|
| 7,331,578 | B2 | 2/2008 | Sano et al. |
| 7,425,001 | B2 * | 9/2008 | Sano et al. ..... 271/242 |

(Continued)

FOREIGN PATENT DOCUMENTS

| | | |
|---|---|---|
| JP | 4451723 | 2/2010 |
| JP | 4451724 | 2/2010 |
| JP | 2012-056729 | 3/2012 |

*Primary Examiner* — Ernesto Suarez

(74) *Attorney, Agent, or Firm* — Harness, Dickey & Pierce, P.L.C.

(57) ABSTRACT

A sheet material conveying device includes: a sheet material housing unit; a sheet material conveying unit that conveys each sheet material to a predetermined conveyance target position; a separating/feeding unit that separates a sheet material from sheet materials in the sheet material housing unit and conveys the separated sheet material alone to the sheet material conveying unit; a multi-feed detecting unit that detects whether multi-feed occurs in which a plurality of sheet materials are fed from the separating/feeding unit to the sheet material conveying unit; and an internal sheet material detecting unit that detects presence of the sheet material in the sheet material conveying unit. The sheet material conveying device performs multi-feed failure detection control for detecting whether a failure occurs in the multi-feed detecting unit before notification of a detection result of the internal sheet material detecting unit.

8 Claims, 15 Drawing Sheets

(51) Int. Cl.

| | |
|---|---|
| ***B65H 1/14*** | (2006.01) |
| ***B65H 3/06*** | (2006.01) |
| ***B65H 3/52*** | (2006.01) |
| ***B65H 5/06*** | (2006.01) |
| ***B65H 9/00*** | (2006.01) |

(52) U.S. Cl.
CPC ..... *B65H 2701/1311* (2013.01); *B65H 2701/1313* (2013.01); *B65H 2801/06* (2013.01); *B65H 2801/39* (2013.01)

(56) References Cited

U.S. PATENT DOCUMENTS

| | | | | |
|---|---|---|---|---|
| 8,444,135 | B2 * | 5/2013 | Morita et al. | 271/3.17 |
| 8,882,107 | B2 * | 11/2014 | Tojo et al. | 271/262 |
| 2005/0269759 | A1 * | 12/2005 | Sano et al. | 271/3.01 |
| 2008/0297580 | A1 | 12/2008 | Fukumoto et al. | |
| 2009/0066008 | A1 | 3/2009 | Hirose et al. | |
| 2011/0187044 | A1 | 8/2011 | Utagawa et al. | |
| 2012/0236375 | A1 | 9/2012 | Fujita et al. | |
| 2012/0313315 | A1 | 12/2012 | Fukumoto et al. | |
| 2013/0215481 | A1 | 8/2013 | Hayasaka et al. | |
| 2013/0228965 | A1 | 9/2013 | Hoshino et al. | |
| 2013/0242359 | A1 | 9/2013 | Heishi et al. | |
| 2013/0315610 | A1 | 11/2013 | Utagawa et al. | |
| 2013/0320611 | A1 | 12/2013 | Kubo et al. | |
| 2014/0084531 | A1 | 3/2014 | Fukumoto et al. | |
| 2014/0140744 | A1 | 5/2014 | Akai et al. | |
| 2014/0145395 | A1 | 5/2014 | Takano et al. | |
| 2014/0159301 | A1 | 6/2014 | Suzuki et al. | |

* cited by examiner

SHEET MATERIAL CONVEYING DEVICE, IMAGE SCANNING DEVICE, AND IMAGE FORMING APPARATUS

CROSS-REFERENCE TO RELATED APPLICATION(S)

The present application claims priority to and incorporates by reference the entire contents of Japanese Patent Application No. 2013-169649 filed in Japan on Aug. 19, 2013.

BACKGROUND OF THE INVENTION

1. Field of the Invention

The present invention relates to a sheet material conveying device that separates and conveys a plurality of sheet materials one by one from a sheet material housing unit that houses the sheet materials and also relates to an image scanning device and an image forming apparatus including the sheet material conveying device.

2. Description of the Related Art

Image scanning devices included in image forming apparatuses, such as scanners, facsimiles, and copiers are provided with automatic document feeders (hereinafter, referred to as "ADFs"). ADFs sequentially feed sheet documents one by one to an image scanning unit for sequential scanning of image information. When conveying documents, ADFs may possibly convey a plurality of overlapping documents, which is called multi-feed. When multi-feed occurs, a part of the documents sequentially fed to the image scanning unit fails to be scanned, resulting in page missing. To address this, there have been developed ADFs including a multi-feed detecting unit that detects multi-feed occurring in conveyed documents at a multi-feed detection position in a document conveying path.

The ADFs disclosed in Japanese Patent No. 4451724 and Japanese Patent No. 4451723 each include an ultrasonic transmitting unit and an ultrasonic receiving unit at positions facing each other with a sheet overlap sensing position in a document conveying path interposed therebetween and include a sheet overlap sensing device that senses multi-feed using ultrasonic waves. In the sheet overlap sensing device, the ultrasonic transmitting unit transmits ultrasonic waves at a timing when a document is present at the portion sandwiched by the ultrasonic transmitting unit and the ultrasonic receiving unit in the conveying path, and the ultrasonic receiving unit receives the ultrasonic waves. The attenuation amount of ultrasonic waves is different between the case where the ultrasonic waves pass through one document and the case where the ultrasonic waves pass through two or more documents. By checking the attenuation amount of the ultrasonic waves received by the ultrasonic receiving unit with respect to the ultrasonic waves transmitted by the ultrasonic transmitting unit, it is possible to determine whether multi-feed occurs.

The sheet overlap sensing device using ultrasonic waves includes the ultrasonic transmitting unit, the ultrasonic receiving unit, and a sensing signal control unit that controls the ultrasonic transmitting unit and the ultrasonic receiving unit. The sensing signal control unit performs control for transmitting a signal to perform ultrasonic wave transmission to the ultrasonic transmitting unit. In addition, the sensing signal control unit receives a reception signal generated based on the ultrasonic waves received by the ultrasonic receiving unit from the ultrasonic receiving unit and controls a signal to be output based on the received reception signal. The sheet overlap sensing device may possibly make an erroneous determination on multi-feed because of the following failures: a failure that occurs in any one of the ultrasonic transmitting unit, the ultrasonic receiving unit, and the sensing signal control unit; and a failure that occurs in a line connecting the ultrasonic transmitting unit and the sensing signal control unit or a line connecting the ultrasonic receiving unit and the sensing signal control unit. In other words, the sheet overlap sensing device may possibly determine that multi-feed occurs despite no multi-feed occurring, and may also possibly determine that multi-feed does not occur despite multi-feed occurring.

Japanese Patent No. 4451724 describes a configuration that enables the device to make a self-diagnosis on whether the sheet overlap sensing device operates normally or abnormally when the power of the device is turned on. Specifically, let us assume a case where an internal document sensing device configured to sense the presence of a document in the conveying path has detected absence of a document when the power of the device is turned on. In this case, if the output value of the ultrasonic receiving element is smaller than a reference value while the ultrasonic transmitting unit is active, it is determined that the sheet overlap sensing device operates abnormally. Also, in a case where the internal document sensing device has detected absence of a document, if the output value of the ultrasonic receiving unit is larger than the reference value while the ultrasonic transmitting unit is inactive, it is determined that the sheet overlap sensing device operates abnormally. Thus, the device makes a self-diagnosis on whether the sheet overlap sensing device operates normally or abnormally. This can prevent the documents from being conveyed when the sheet overlap sensing device has a failure and may possibly make an erroneous determination on multi-feed.

In the ADF described in Japanese Patent No. 4451724, if the internal document sensing device detects that a document is present in the conveying path when the power of the device is turned on, the ADF notifies a user that the document is present. After the user finishes removing the document, the ADF performs control for checking whether a document is present in the conveying path again. After detecting that no document is present, the ADF performs control for checking whether a failure occurs in the sheet overlap sensing device.

With a document present in the conveying path, such an ADF does not detect a failure occurring in the sheet overlap sensing device before the user finishes removing the document even if the failure has already occurred in the sheet overlap sensing device when the power of the device is turned on. The failure in the sheet overlap sensing device is repaired by a professional repairer called a service person by replacement of parts and connection of lines, for example. If it is detected that a failure occurs in the sheet overlap sensing device after the user finishes removing the document, the following problem occurs. Although the user expects scanning of a document to be enabled immediately by removing the document, the failure in the sheet overlap sensing device is detected after removing the document. As a result, the user needs to ask a service person to come, failing to scan the document immediately, after all.

The problem described above occurs not only in a document conveying device that conveys a document as a sheet material. It may possibly occur in any sheet material conveying device that conveys one sheet material from a sheet housing unit separately from other sheet materials and includes a multi-feed detecting unit configured to check whether a plurality of sheet materials to be conveyed separately do not overlap with one another. Furthermore, the problem occurs not only in a sheet material conveying device including a multi-feed detecting unit using ultrasonic waves. It may possibly occur in any sheet material conveying device that detects occurrence of a failure in the multi-feed detecting unit and whether a sheet material remains in a sheet material conveying path at a predetermined timing, such as a timing of power-on.

In view of the above, there is a need to provide a sheet conveying device that can notify, when a failure occurs in a multi-feed detecting unit with a sheet material present in a conveying path, a user that the failure occurs in the multi-feed detecting unit before causing the user to expect conveyance of a sheet material to be enabled simply by removing the sheet material. There is also a need to provide an image scanning device and an image forming apparatus including such a sheet conveying device.

SUMMARY OF THE INVENTION

It is an object of the present invention to at least partially solve the problems in the conventional technology.

A sheet material conveying device includes: a sheet material housing unit that houses a plurality of sheet materials in a stacked manner; a sheet material conveying unit that conveys each of the sheet materials to a predetermined conveyance target position; a separating/feeding unit that separates a sheet material from the sheet materials in the sheet material housing unit and conveys the separated sheet material alone to the sheet material conveying unit; a multi-feed detecting unit that detects whether multi-feed occurs in which a plurality of sheet materials are fed from the separating/feeding unit to the sheet material conveying unit; and an internal sheet material detecting unit that detects presence of the sheet material in the sheet material conveying unit. The sheet material conveying device performs multi-feed failure detection control for detecting whether a failure occurs in the multi-feed detecting unit before notification of a detection result of the internal sheet material detecting unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 10B is a view for explaining the state where two documents are present at the detection position;

DETAILED DESCRIPTION OF THE PREFERRED EMBODIMENTS

The present invention is applicable to an automatic document feeder (ADF), which conveys a document to an image scanning unit of a copier or a facsimile or to a scanning unit of an image scanning device, such as a scanner. The present invention is applicable not only to an ADF but also to a sheet material conveying device that conveys a sheet material, such as a document or a transfer sheet. Examples of the sheet material conveying device include a paper feeding unit that conveys a transfer sheet from a sheet stacker to the inside of a copier in the copier. The following describes an embodiment of the present invention by explaining conveyance of a document in a sheet-through ADF mounted on a copier as a typical example of a device to which the present invention is applicable.

Figure 2:
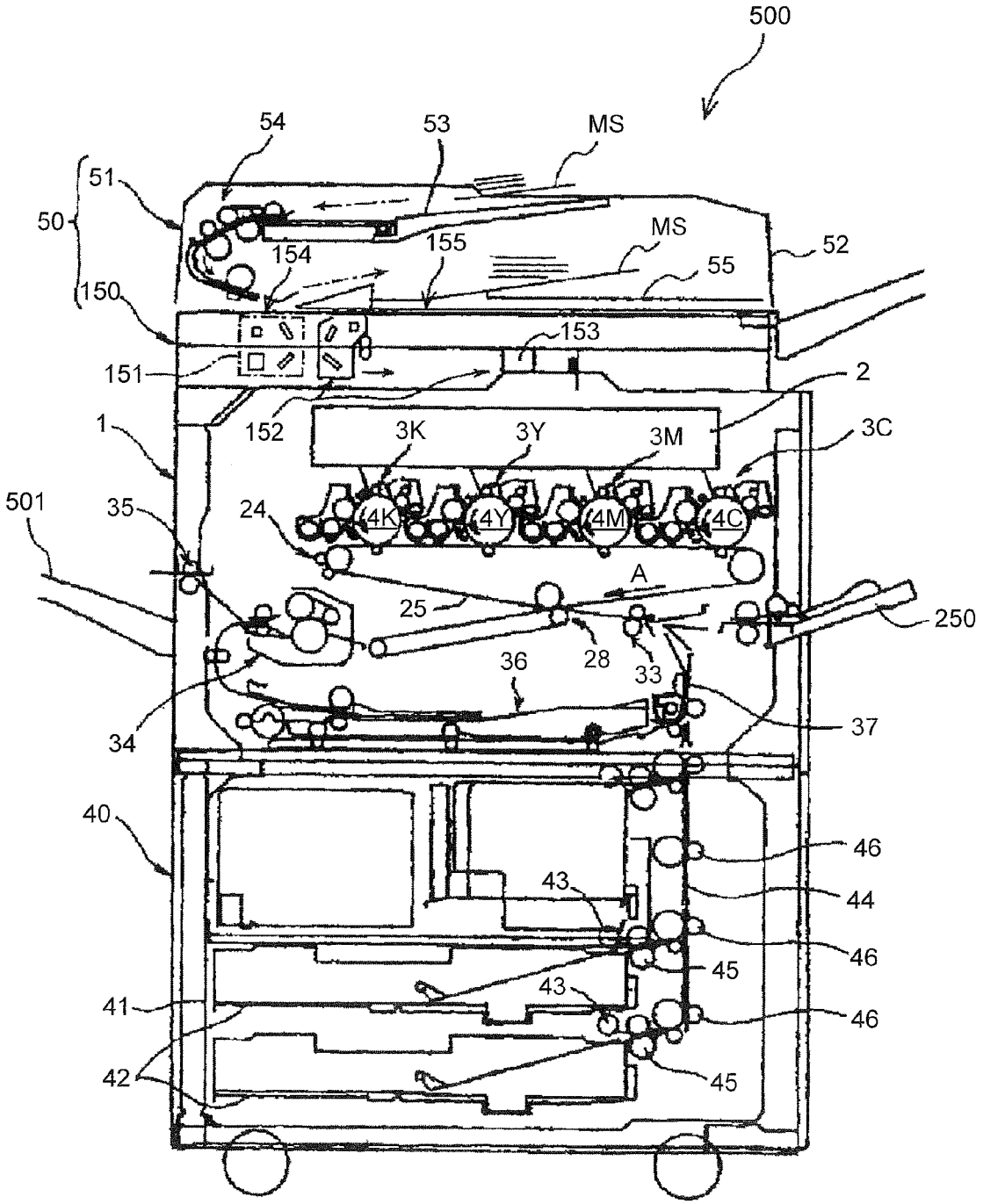
FIG. 2 is a schematic configuration diagram of a copier according to the embodiment.

A description will be made below of an embodiment in which the present invention is applied to an electrophotographic copier (hereinafter called simply a copier 500). First, a basic configuration of the copier 500 according to the present embodiment will be described. FIG. 2 is a schematic configuration diagram of the copier 500. The copier 500 includes an image forming unit 1 serving as an image forming unit, a transfer sheet feeding device 40, and an image scanning unit 50. The image scanning unit 50 serving as an image scanning device includes a scanner 150 fixed on the image forming unit 1 and an automatic document feeder (hereinafter, referred to as an ADF 51) serving as a sheet material feeder supported by the scanner 150.

The transfer sheet feeding device 40 includes two transfer sheet feed cassettes 42 arranged in multiple stages in a paper bank 41. The transfer sheet feeding device 40 further includes transfer sheet feed-out rollers 43 and transfer sheet separation rollers 45. The transfer sheet feed-out rollers 43 feed transfer sheets P from the transfer sheet feed cassettes 42. The transfer sheet separation rollers 45 separate the fed-out transfer sheets P and feed them to a transfer sheet feed path 44. The transfer sheet feeding device 40 also includes a plurality of pairs of carriage rollers 46 that convey the transfer sheets P serving as recording media to a main body transfer sheet feed path 37 serving as a transfer sheet conveying path of the image forming unit 1. The transfer sheet feeding device 40 feeds the transfer sheets P in the transfer sheet feed cassettes 42 to the main body transfer sheet feed path 37 in the image forming unit 1.

The image forming unit 1 includes an optical writing device 2 and four process units 3K, 3Y, 3M, and 3C that form toner images having colors of black, yellow, magenta, and cyan (K, Y, M, and C), respectively. The image forming unit 1 further includes a transfer unit 24, a sheet conveying unit 28, a pair of registration rollers 33, a fixing device 34, a transfer sheet reversing device 36, and the main body transfer sheet feed path 37. The optical writing device 2 drives light sources, such as laser diodes or light emitting diodes (LEDs) (not illustrated), arranged in itself to emit laser beams L toward four drum-like photosensitive elements 4K, 4Y, 4M, and 4C. This laser beam emission forms electrostatic latent images on the surfaces of the photosensitive elements 4K, 4Y, 4M, and 4C, and the latent images are developed into toner images through a predetermined developing process.

Figure 3:
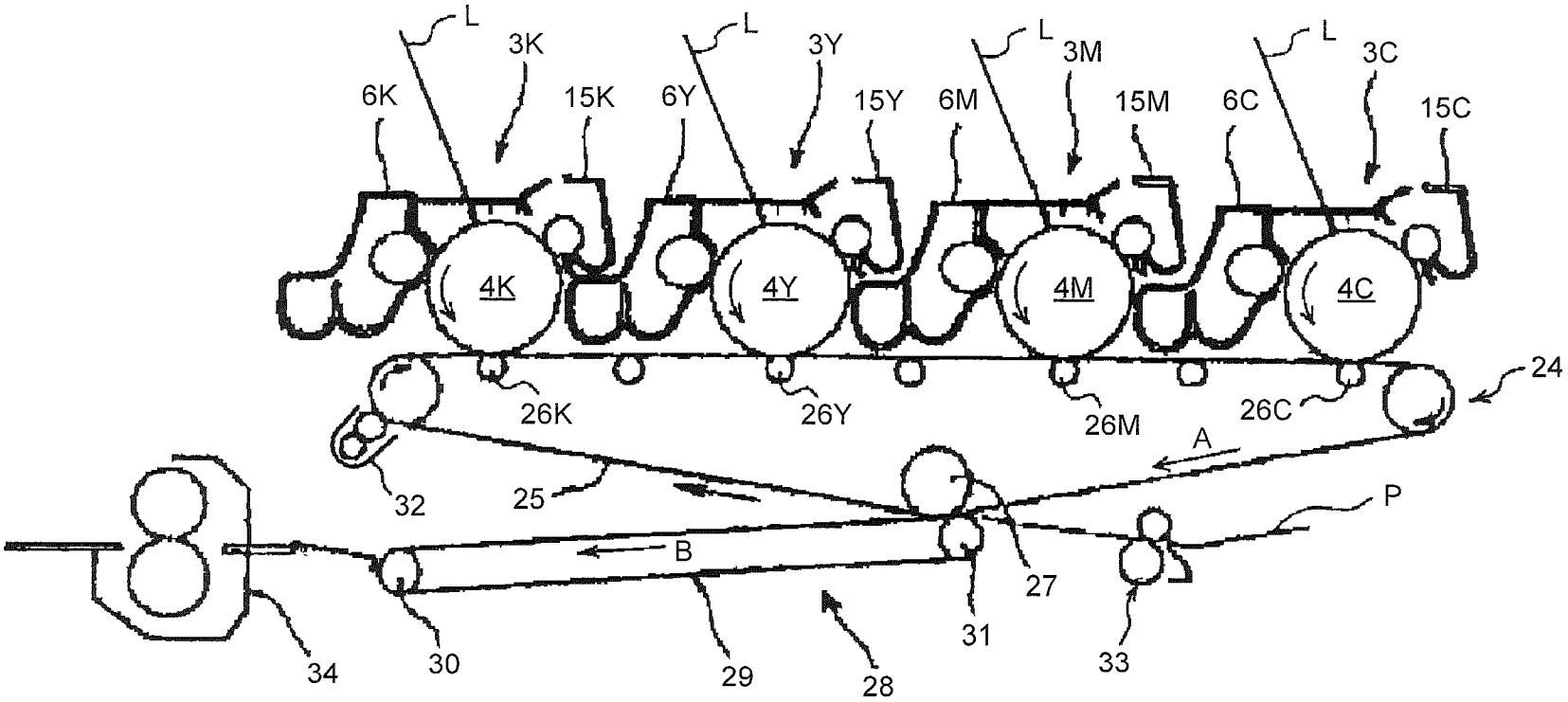
FIG. 3 is a partial configuration diagram illustrating a part of an image forming unit in the copier in an enlarged scale.
Figure 4:
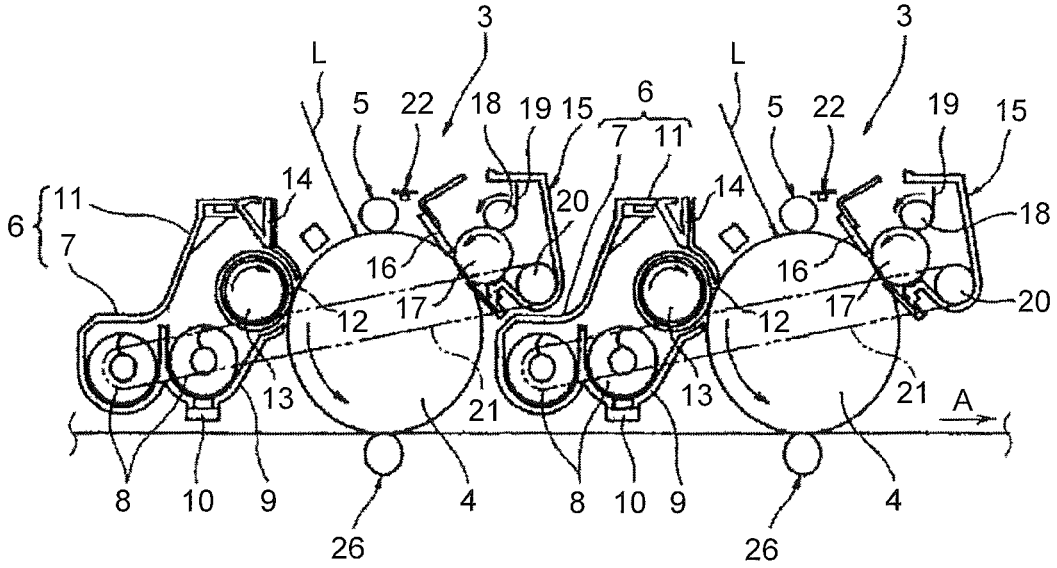
FIG. 4 is a partial enlarged diagram illustrating a part of a tandem unit composed of four process units in the image forming unit.

FIG. 3 is a partial configuration diagram illustrating a part of an internal configuration of the image forming unit 1 in an enlarged scale. FIG. 4 is a partial enlarged diagram of a part of a tandem unit composed of the four process units 3K, 3Y, 3M, and 3C. The four process units 3K, 3Y, 3M, and 3C have substantially the same configuration except that the colors of toners used in the respective units are different from one another. Thus, the subscripts K, Y, M, and C assigned to the respective reference numerals to indicate the colors of toners are omitted in FIG. 4.

Each of the process units 3K, 3Y, 3M, and 3C supports the photosensitive element 4 and various devices arranged therearound as one unit on a common supporting member, and is mountable to and removable from the image forming unit 1 in a body of the copier 500. The process units 3 each include a charging device 5, a developing device 6, a drum cleaning device 15, and a neutralization lamp 22 around the photosensitive element 4. The copier 500 has a commonly called tandem configuration in which the four process units 3K, 3Y, 3M, and 3C are disposed opposite to an intermediate transfer belt 25, to be described later, so as to be arranged along the endlessly moving direction thereof.

The photosensitive element 4 uses a drum-like member made of an element tube of aluminum or the like on which a photosensitive layer is formed by applying an organic photosensitive material having photosensitivity. The photosensitive element 4 may instead use an endless belt-like member.

The developing device 6 develops the latent image using a two-component developer (not illustrated) containing a magnetic carrier and a nonmagnetic toner. The developing device 6 includes a stirring unit 7 that conveys, while stirring, the two-component developer contained therein and supplies the developer to a developing sleeve 12, and a developing unit 11 for transferring the toner in the two-component developer carried on the developing sleeve 12 to the photosensitive element 4.

The stirring unit 7 is provided at a position lower than the developing unit 11, and includes two conveying screws 8 arranged in parallel with each other, a partition plate provided between the two conveying screws 8, and a toner concentration sensor 10 provided on the bottom surface of a developing case 9.

The developing unit 11 includes the developing sleeve 12 facing the photosensitive element 4 through an opening of the developing case 9, a magnetic roller 13 nonrotatably provided inside of the developing sleeve 12, and a doctor blade 14 that brings an end thereof close to the developing sleeve 12. The developing sleeve 12 is a nonmagnetic rotatable cylindrical sleeve. The magnetic roller 13 has a plurality of magnetic poles sequentially arranged from a position facing the doctor blade 14 toward the direction of rotation of the developing sleeve 12. Each of these magnetic poles applies a magnetic force to the two-component developer on the developing sleeve 12 in a predetermined position in the direction of rotation. This causes the two-component developer fed from the stirring unit 7 to be attracted to the surface of the developing sleeve 12 and carried thereon, and forms a magnetic brush along magnetic field lines on the surface of the developing sleeve 12.

As the developing sleeve 12 rotates, the magnetic brush is restricted to have an appropriate layer thickness at the time of passing through the position facing the doctor blade 14, and then conveyed to a developing area facing the photosensitive element 4. The magnetic brush then transfers the toner onto the electrostatic latent image by using a potential difference between a developing bias applied to the developing sleeve 12 and the electrostatic latent image on the photosensitive element 4 so as to contribute to the development. The two-component developer, after forming the magnetic brush and then passing through the developing area while being carried on the developing sleeve 12, returns to the inside of the developing unit 11 along with the rotation of the developing sleeve 12. After being separated from the surface of the sleeve due to an effect of a repulsive magnetic field formed between the magnetic poles of the magnetic roller 13, the two-component developer is returned to the stirring unit 7. An appropriate amount of the toner is replenished to the two-component developer in the stirring unit 7 based on a detection result by the toner concentration sensor 10. The developing device 6 may employ a type that uses a one-component developer containing no magnetic carrier, instead of the type that uses two-component developer.

While the drum cleaning device 15 uses a technique for pressing a cleaning blade 16 made of an elastic body against the photosensitive element 4, any other technique may be used. For the purpose of enhancing cleaning performance, the present embodiment employs a system that includes a contact conductive fur brush 17 with the outer circumferential surface thereof contacting the photosensitive element 4 in a manner rotatable in the direction of an arrow in FIG. 4. The fur brush 17 also scrapes off a lubricant from a solid lubricant (not illustrated) to make the lubricant a fine powder and applies it onto the surface of the photosensitive element 4. A metal electric field roller 18 that applies a bias to the fur brush 17 is rotatably provided in the direction of an arrow in FIG. 4, and an end of a scraper 19 is pressed against the electric field roller 18.

The toner attached from the photosensitive element 4 to the fur brush 17 is transferred onto the electric field roller 18 to which a bias is applied while the electric field roller 18 rotates counter to the fur brush 17 in contact with it. The toner transferred onto the electric field roller 18 is scraped off by the scraper 19 from the electric field roller 18 and falls onto a recovery screw 20. The recovery screw 20 conveys the recovered toner recovered from the surface of the photosensitive element 4 by the fur brush 17 and the cleaning blade 16 toward an end of the drum cleaning device 15 in the direction perpendicular to the plane of FIG. 4 and transfers the recovered toner to an external recycle conveying device 21. The recycle conveying device 21 feeds the transferred toner to the developing device 6, thereby recycling the toner.

The neutralization lamp 22 neutralizes the surface of the photosensitive element 4 using light irradiation. The surface of the neutralized photosensitive element 4 is uniformly charged by the charging device 5, and then is subjected to an optical writing process by the optical writing device 2. The copier 500 uses the charging device 5 that rotates a charging roller, to which a charging bias is applied, while keeping the charging roller in contact with the photosensitive element 4. Alternatively, the copier 500 may use a scorotron charger that charges the photosensitive element 4 in a contactless manner, for example.

In FIG. 3 exhibited above, black, yellow, magenta, and cyan toner images are formed by the process described above on the photosensitive elements 4K, 4Y, 4M, and 4C of the four process units 3K, 3Y, 3M, and 3C, respectively.

The transfer unit 24 is disposed below the four process units 3K, 3Y, 3M, and 3C. The transfer unit 24 keeps the intermediate transfer belt 25 stretched around a plurality of rollers in contact with the photosensitive elements 4K, 4Y, 4M, and 4C, thereby forming primary transfer nips for K, Y, M, and C. In the transfer unit 24, one of the rollers around which the intermediate transfer belt 25 is stretched is rotationally driven as a driving roller, thereby endlessly moving the intermediate transfer belt 25 in the direction of the arrow A (clockwise direction) in FIG. 3.

This forms each of primary transfer nips at which the photosensitive elements 4K, 4Y, 4M, and 4C come in contact with the intermediate transfer belt 25. Primary transfer rollers 26K, 26Y, 26M, and 26C arranged inside the belt loop press the intermediate transfer belt 25 against the photosensitive elements 4K, 4Y, 4M, and 4C near the primary transfer nips for K, Y, M, and C. A power source (not illustrated) applies a primary transfer bias to each of the primary transfer rollers 26K, 26Y, 26M, and 26C. This causes the primary transfer nips for K, Y, M, and C to form primary transfer electric fields that electrostatically move the toner images on the photosensitive elements 4K, 4Y, 4M, and 4C toward the intermediate transfer belt 25. The toner images are primarily transferred at the respective primary transfer nips so as to be sequentially superimposed on each other onto the outer surface of the intermediate transfer belt 25 that sequentially passes through the primary transfer nips for K, Y, M, and C along with the endless movement in the direction of the arrow A (clockwise direction) in FIGS. 2 and 3. This superimposed primary transfer forms a toner image of four superimposed colors (hereinafter called a four-color toner image) on the outer surface of the intermediate transfer belt 25.

The sheet conveying unit 28 is provided below the transfer unit 24 in FIG. 3, and includes an endless sheet conveying belt 29 stretched between a paper feeding driving roller 30 and a secondary transfer roller 31 to make endless movement. As illustrated in FIG. 2 and FIG. 3, the intermediate transfer belt 25 and the sheet conveying belt 29 are nipped between a lower tension roller 27 serving as one of the rollers around which the intermediate transfer belt 25 is stretched and the secondary transfer roller 31. This forms a secondary transfer nip at which the outer surface of the intermediate transfer belt 25 comes into contact with the outer surface of the sheet conveying belt 29. The secondary transfer roller 31 is supplied with a secondary transfer bias by a power source (not illustrated), and the lower tension roller 27 is grounded. This forms a secondary transfer electric field at the secondary transfer nip.

The pair of registration rollers 33 is arranged on the right side of the secondary transfer nip in FIG. 3. A registration roller sensor (not illustrated) is arranged near the entrance of the registration nip of the pair of registration rollers 33. The transfer sheet P conveyed from the transfer sheet feeding device 40 toward the pair of registration rollers 33 is temporarily stopped after a predetermined time has passed since its leading end is detected by the registration roller sensor (not illustrated). Thus, the leading end abuts on the registration nip of the pair of registration rollers 33. This corrects the position of the transfer sheet P, thereby making the transfer sheet P ready for being synchronized with image formation.

When the leading end of the transfer sheet P abuts on the registration nip, the pair of registration rollers 33 restarts to rotationally drive the rollers at a timing when the transfer sheet P can be synchronized with the four-color toner image on the intermediate transfer belt 25, thereby feeding out the transfer sheet P to the secondary transfer nip. In the secondary transfer nip through which the transfer sheet P passes, the four-color toner image on the intermediate transfer belt 25 is secondarily transferred onto the transfer sheet P collectively by the effects of the secondary transfer electric field and a nip pressure. The four-color toner image is combined with white of the transfer sheet P and formed into a full-color image. The transfer sheet P having passed through the secondary transfer nip is separated from the intermediate transfer belt 25, and, while being held on the outer surface of the sheet conveying belt 29, is conveyed to the fixing device 34 as the belt 29 endlessly moves.

A remaining post-transfer toner that has not been transferred to the transfer sheet P at the secondary transfer nip is attached on the surface of the intermediate transfer belt 25 that has passed through the secondary transfer nip. This remaining post-transfer toner is scraped off and removed by a belt cleaning device 32 a cleaning member of which contacting the intermediate transfer belt 25.

The full-color image is fixed to the transfer sheet P conveyed to the fixing device 34 with the application of pressure and heat in the fixing device 34. The transfer sheet P on which the full-color image is fixed is conveyed from the fixing device 34 to a pair of ejecting rollers 35 and is discharged onto a discharge tray 501 outside of the apparatus.

As illustrated in FIG. 2, the transfer sheet reversing device 36 is arranged below the sheet conveying unit 28 and the fixing device 34. To perform duplex printing, the transfer sheet P subjected to the image fixing processing on one surface is switched by a switching claw to the conveying path leading to the transfer sheet reversing device 36. The transfer sheet P is reversed in the transfer sheet reversing device 36 and enters the secondary transfer nip again. After secondary transfer processing and fixing processing of an image are performed on the other surface of the transfer sheet P, the transfer sheet P is discharged onto the discharge tray 501.

The following describes the image scanning unit 50 fixed on the image forming unit 1. The image scanning unit 50 formed of the scanner 150 and the ADF 51 fixed on the scanner 150 includes two fixed image scanning units and a movable scanning unit 152, which will be described later. Two types of document scanning systems can be used in the image scanning unit 50, which are a document-fixed scanning system and a document-conveyed scanning system. In the document fixed-scanning system, a document is scanned as follows: the ADF 51 is opened; a document MS is placed on a second exposure glass 155; the ADF 51 is closed; and the movable scanning unit 152 scans the surface of the document MS. In the document-conveyed scanning system, a document is scanned as follows: the document MS is placed on a document placing table 53 provided to the ADF 51; the ADF 51 conveys the document MS to a first exposure glass 154; and the fixed scanning units (151 and 95) scans the surface of the document.

The movable scanning unit 152 is disposed immediately below a second contact glass 155 that is fixed on an upper wall of a casing of the scanner 150 so as to be in contact with a document MS, and can move an optical system composed of a light source, reflecting mirrors, and the like in the right and left directions in FIG. 2. In the process of moving the optical system from left to right in FIG. 2, light emitted from the light source is reflected on the lower surface of the document MS placed on the second contact glass, and then, after being reflected on the reflecting mirrors, received by an image scanning sensor 153 fixed to the scanner 150.

The image scanning unit 50 includes a first fixed scanning unit 151 arranged in the scanner 150 and a second fixed scanning unit 95, which will be described later, arranged in the ADF 51 as the fixed image scanning units. The first fixed scanning unit 151 includes a light source, a reflecting mirror, and an image scanning sensor such as a charge-coupled device (CCD). The first fixed scanning unit 151 is arranged just below the first exposure glass 154 fixed on the upper wall of the casing of the scanner 150 so as to be in contact with the document MS. When the document MS conveyed by the ADF 51 passes on the first contact glass 154, light emitted from a light source is sequentially reflected on a first surface of the document, and after being reflected on a plurality of reflecting mirrors, received by the image scanning sensor 153. This causes a first surface of the document MS to be scanned without moving an optical system composed of the light source and the reflecting mirrors. The second fixed scanning unit 95 (refer to FIG. 1), which will be described later, scans the second surface of the document MS that has passed through the first fixed scanning unit 151.

Figure 5:
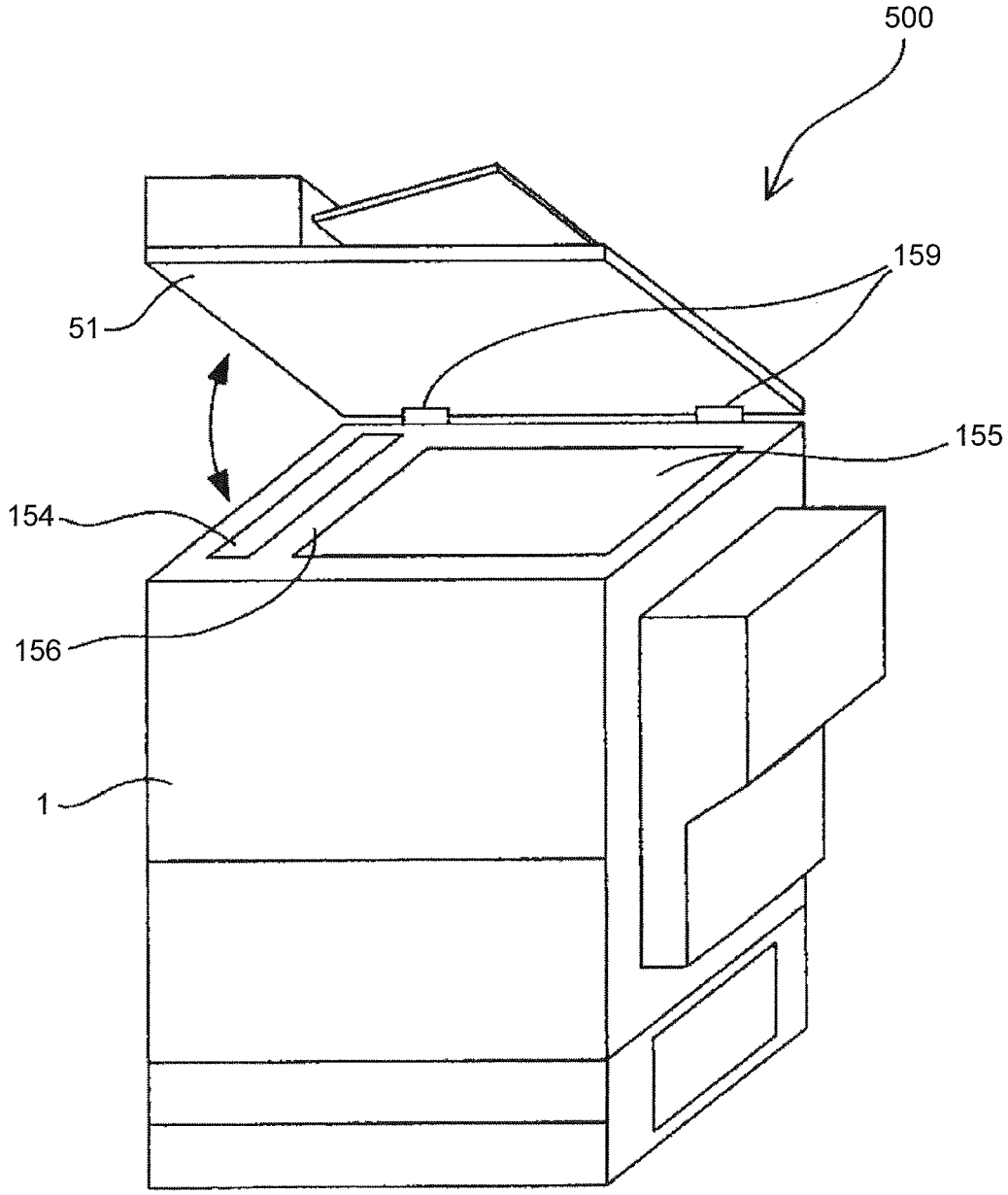
FIG. 5 is a perspective view for explaining the copier when the ADF is opened.
Figure 6:
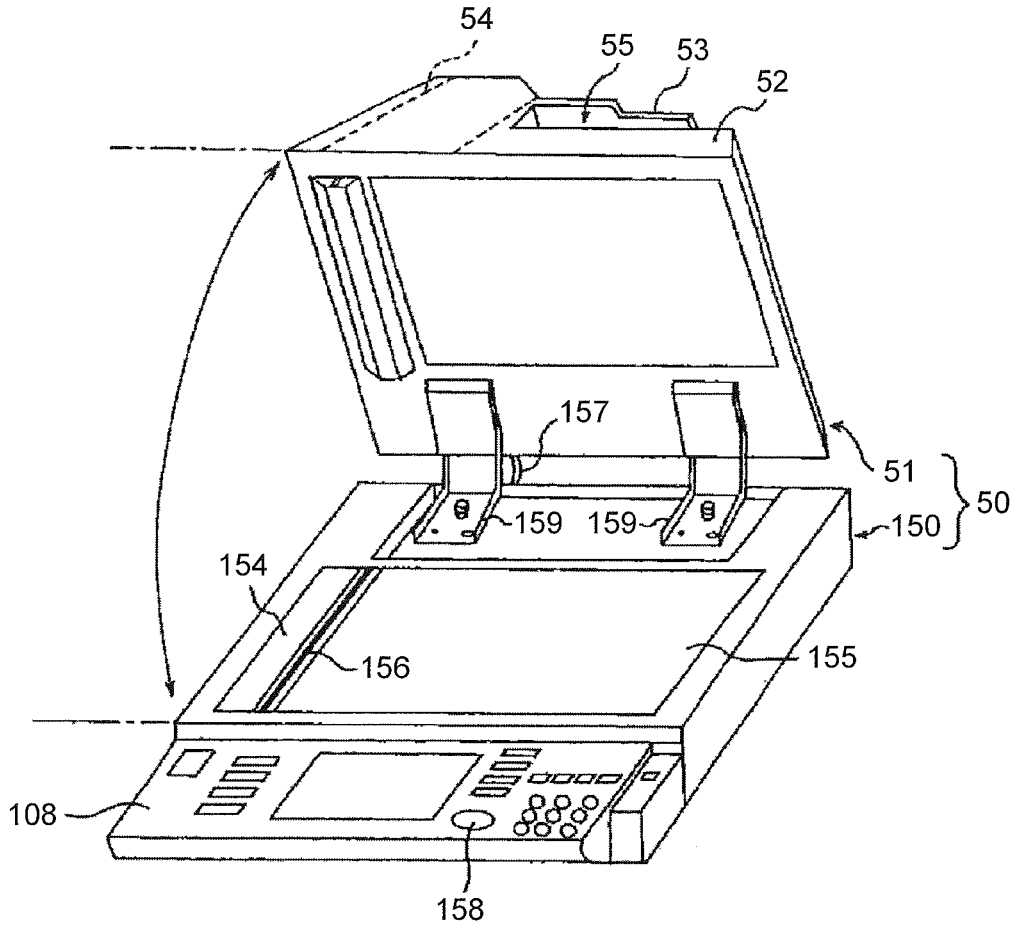
FIG. 6 is a perspective view for explaining an image scanning unit when the ADF is opened.

The ADF 51 disposed on top of the scanner 150 retains, in a body cover 52 thereof, a document placing table 53 for placing thereon the document MS before scanning, a document conveying path 54 for conveying the document MS as a sheet material, a document stacking table 55 for stacking the document MS after scanning, and so on. FIG. 5 is a perspective view for explaining the copier 500 when the ADF 51 is opened. FIG. 6 is a perspective view for explaining the image scanning unit 50 when the ADF 51 is opened. As illustrated in FIG. 6, the ADF 51 is supported by hinges 159 fixed on the scanner 150 so as to be swingable in the up and down directions. The ADF 51 makes the swinging motion like an open/close door, and when it is opened, exposes a first contact glass 154 and a second contact glass 155 on the top surface of the scanner 150.

Figure 1:
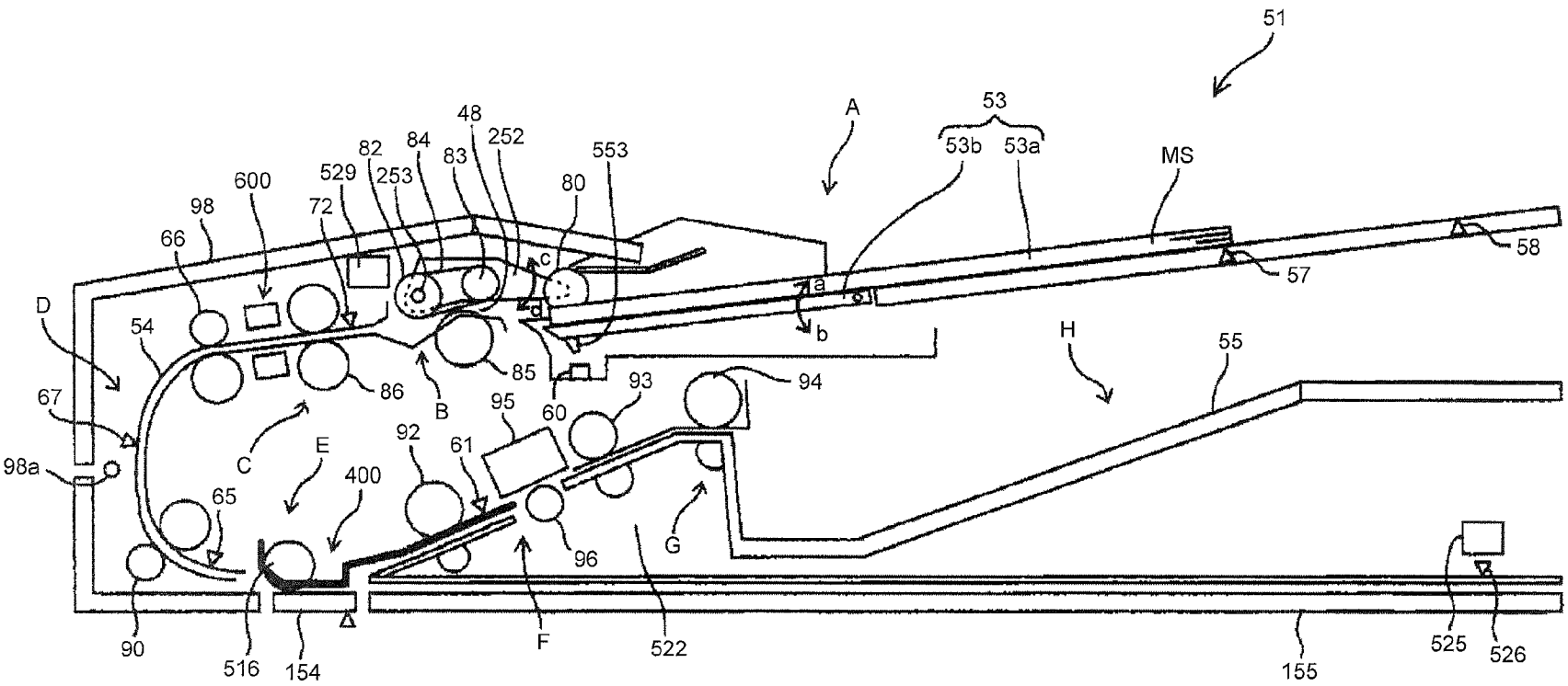
FIG. 1 is a schematic configuration diagram illustrating an ADF according to an embodiment together with an upper part of a scanner.
Figure 7:
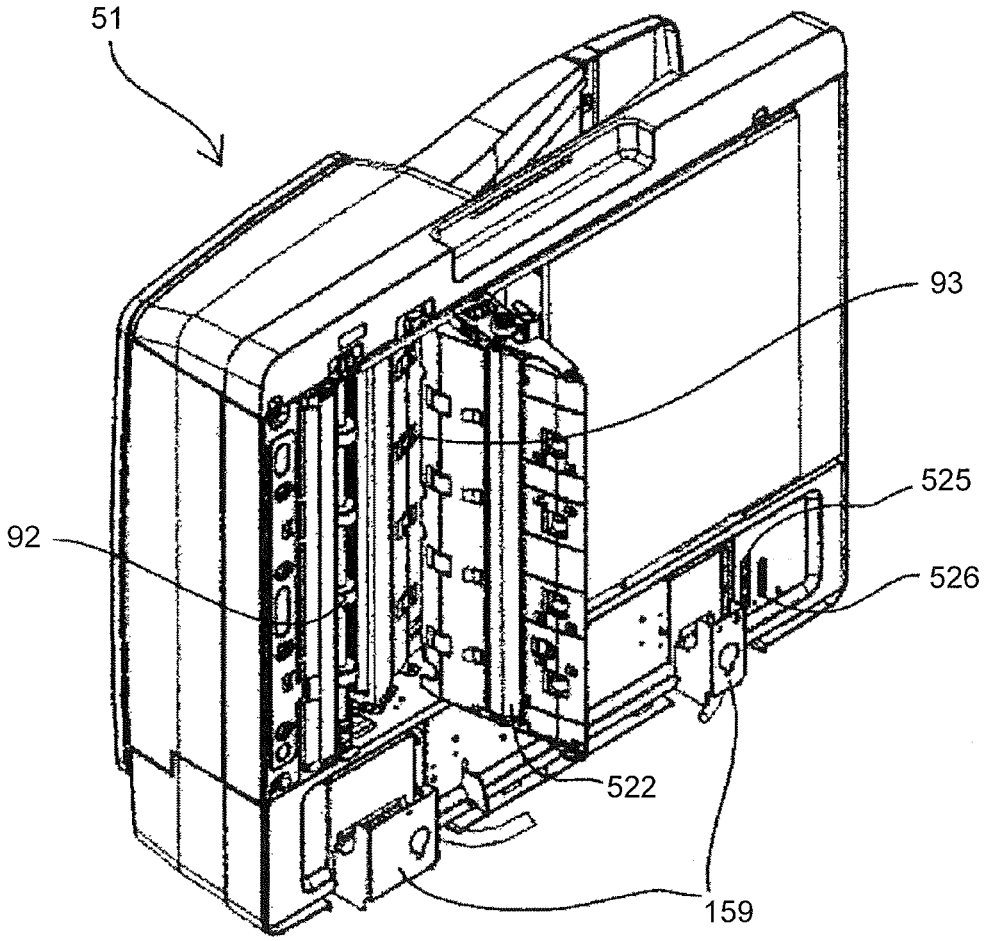
FIG. 7 is a view for explaining the rear surface portion of the ADF.

FIG. 1 is an enlarged configuration diagram illustrating the main part configuration of the ADF 51 together with the upper part of the scanner 150. FIG. 7 is a view for explaining the back side portion of the ADF 51 and illustrates the state where the ADF 51 is opened with respect to the image forming unit 1.

A pressurizing plate opening/closing detection sensor 526 is provided to the rear surface portion of the ADF 51 and determines which of the two types of document scanning systems is to be selected. In association with the pressurizing plate opening/closing detection sensor 526, a pressurizing plate interlock switch 525 attached above the pressurizing plate opening/closing detection sensor 526 is turned ON and OFF. FIG. 7 illustrates the state where a back side unit 522 is opened. When the document MS is jammed on the downstream of a document conveying path in the ADF 51, that is, near a discharging unit, a user opens the back side unit 522 serving as a discharging unit cover as illustrated in FIG. 7 to remove the jammed document MS. After removing the document MS, the user closes the back side unit 522.

In the case of a side-stitched document, such as a book formed by stitching a side of a document bundle, the documents cannot be separated one by one. Because the ADF 51 cannot convey the documents, the document-fixed scanning system is used. Therefore, when the document is a side-bound document, the ADF 51 is opened as illustrated in FIG. 6, and a page to be scanned of the side-bound document is opened and placed facing downward on the second contact glass 155. Thereafter, the ADF 51 is closed. Then, the movable scanning unit 152 of the scanner 150 illustrated in FIG. 2 scans an image on the page. A left scale 156 is arranged at the left end of the second exposure glass 155. In the document-fixed scanning system, a document is placed on the second exposure glass 155 in a manner abutting on the graduations of the left scale 156, and then scanning of an image is performed.

By contrast, in the case of a document bundle formed simply by stacking a plurality of documents MS independent of one another, the ADF 51 can automatically convey the documents MS one by one. Thus, the document-conveyed scanning system is used. In the document-conveyed scanning system, the first fixed scanning unit 151 in the scanner 150 and the second fixed scanning unit 95 in the ADF 51 sequentially scans the documents MS while the documents MS are being conveyed. In this case, the user who intends to copy the images of the documents sets the document bundle on the document placing table 53 and presses a copy start button 158 of an operating unit 108. Then, the ADF 51 feeds the documents MS of the document bundle placed on the document placing table 53 sequentially from the top downward into the document conveying path 54, and conveys, while reversing, the documents toward the document stacking table 55. In this conveying process, the document MS immediately after being reversed is passed directly above the first fixed scanning unit 151 of the scanner 150. At this time, the first fixed scanning unit 151 of the scanner 150 scans an image on the first surface of the document MS.

The ADF 51 will now be described. The ADF 51 includes units such as a document setting unit A, a separating/feeding unit B, a registration unit C, a turning unit D, a first scan conveying unit E, a second scan conveying unit F, a discharging unit G, and a stacking unit H. A document conveying path 54 of the ADF 51 according to the present embodiment is a path through which the document MS is conveyed from the detection position of an abutting sensor 72 positioned downstream of the separating/feeding unit B to a pair of scanning entrance rollers 90. The ADF 51 further includes a paper feeding unit cover 98 that rotates about a cover rotating shaft **98*a* with respect to the apparatus main body, thereby covering and uncovering the document conveying path in the separating/feeding unit B, the registration unit C, and the midway of the turning unit D. When a paper jam occurs near the paper feeding unit for the document MS, the user opens the paper feeding unit cover 98. The user removes the document MS causing the paper jam and then closes the paper feeding unit cover 98**.

The document setting unit A includes the document placing table 53 on which the bundle of the documents MS is set such that the first surfaces of the documents MS face upward. The separating/feeding unit B separates and feeds the documents MS one by one from the bundle of the documents MS set on the table. The registration unit C has a function to adjust the fed document MS by causing the document MS to primarily abut thereon and a function to pull out and convey the adjusted document MS. The turning unit D includes a curved conveying portion curved in a C-shape. The turning unit D turns and reverses the conveyed document MS upside down in the curved conveying portion, thereby conveying the document MS such that the first surface thereof faces downward. A multi-feed detecting mechanism 600 is arranged between the registration unit C and the turning unit D. The multi-feed detecting mechanism 600 detects occurrence of multi-feed in which a plurality of documents MS that has passed through the separating/feeding unit B overlap with one another.

The first scan conveying unit E conveys the document MS over the first exposure glass 154 made of platen glass. While conveying the document MS, the first scan conveying unit E causes the first fixed scanning unit 151 arranged in the scanner 150 to scan the first surface of the document MS from below the first exposure glass 154. In the second scan conveying unit F, a second scanning roller 96 is arranged below the second fixed scanning unit 95. While conveying the document MS that has passed through the scanning position of the first fixed scanning unit 151 with the second scanning roller 96, the second scan conveying unit F causes the second fixed scanning unit 95 to scan the second surface of the document MS. The discharging unit G discharges the document MS that has passed through the scanning position of the first fixed scanning unit 151 and the scanning position of the second fixed scanning unit 95 toward the stacking unit H. The stacking unit H stacks and supports the documents MS subjected to the scanning on the document stacking table 55.

Figure 8:
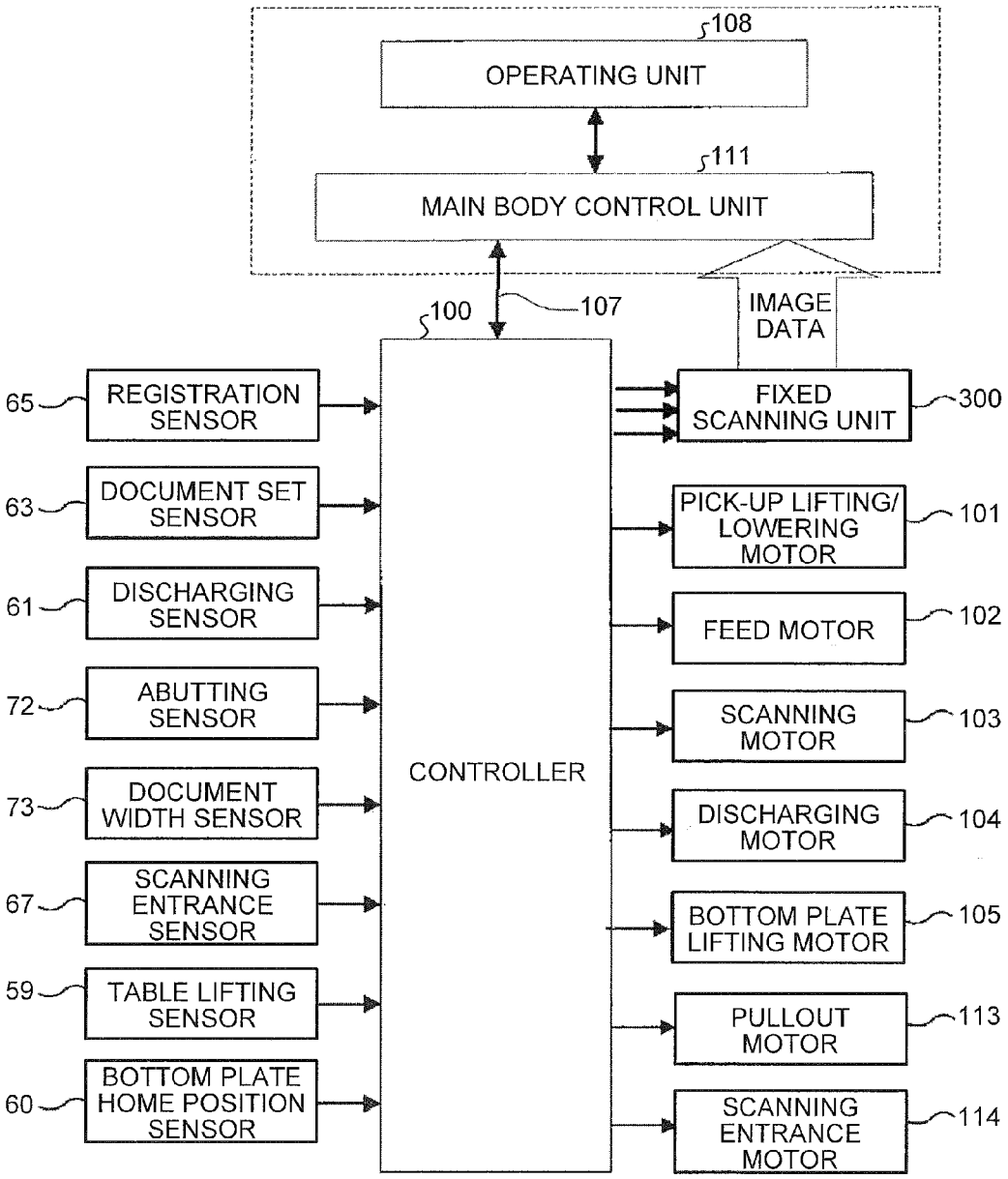
FIG. 8 is a control block diagram of the entire ADF.

FIG. 8 is a control block diagram of the entire ADF 51. A control unit of the ADF 51 is formed of a controller 100 that controls a series of operations of each motor, various types of sensors, and a fixed image scanning unit 300, for example. Each motor (101 to 105, 113, or 114) is a driving unit that drives a document conveying operation. The fixed image scanning unit 300 in FIG. 8 corresponds to the first fixed scanning unit 151 and the second fixed scanning unit 95.

Figure 9:
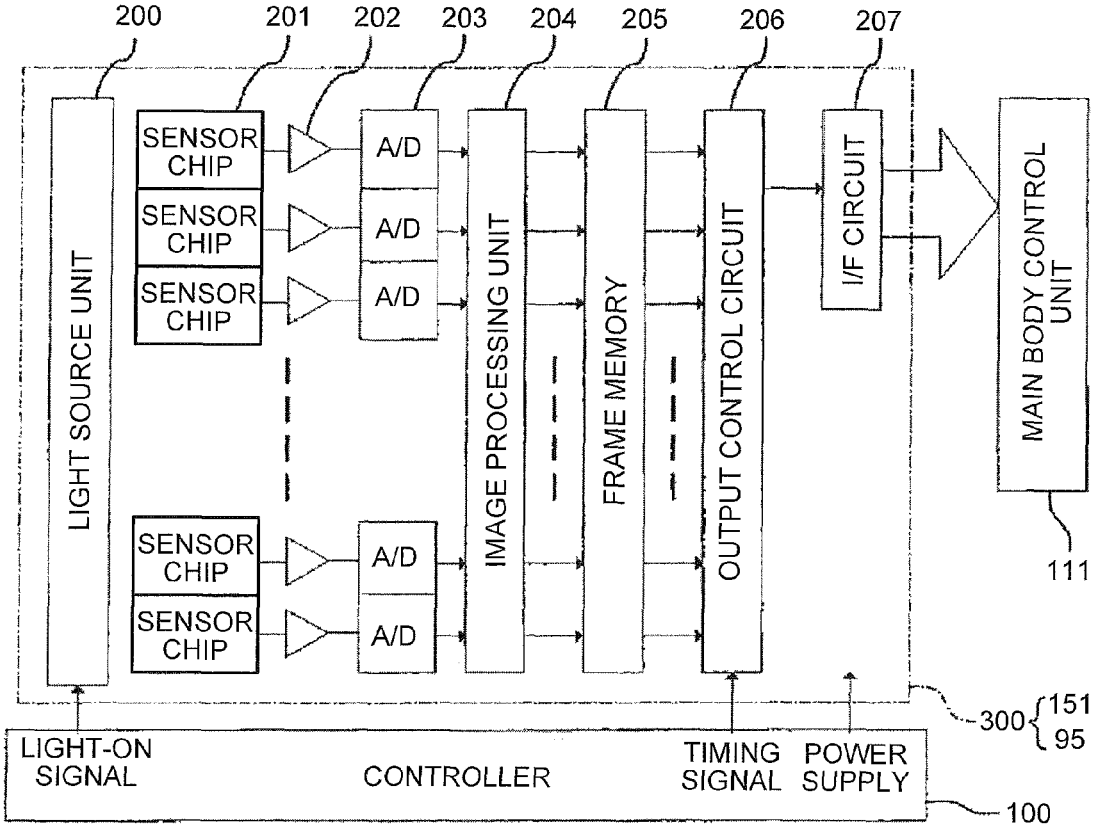
FIG. 9 is a block diagram of the main part of an electrical circuit of a fixed image scanning unit.

FIG. 9 is a block diagram of the main part of an electrical circuit of the fixed image scanning unit 300. The fixed image scanning unit 300 includes a light source unit 200, sensor chips 201, an image processing unit 204, a frame memory 205, an output control circuit 206, and an interface circuit 107 (an "I/F circuit" in FIG. 9). The light source unit 200 is formed of a light-emitting diode (LED) array, a fluorescent lamp, a cold-cathode tube, or the like. The sensor chips 201 are arranged side by side in the main-scanning direction (direction corresponding to the document width direction). A plurality of operational (OP) amplifier circuits are individually connected to the respective sensor chips 201. A plurality of analog/digital (A/D) converters 203 are individually connected to the respective OP amplifier circuits 202.

The sensor chips 201 each include a photoelectric conversion element referred to as an equal-magnification contact image sensor and a condensing lens. Before the document MS enters the scanning position of the fixed image scanning unit 300, the controller 100 sends a light-on signal to the light source unit 200. Thus, the light source unit 200 is turned on and irradiates a surface of a document (the first surface in the case of the first fixed scanning unit 151 and the second surface in the case of the second fixed scanning unit 95), which is not illustrated, with the light. In the sensor chips 201, reflected light reflected on the surface of the document MS is condensed by the condensing lens on the photoelectric conversion element and is scanned as image information. The image information scanned by each of the sensor chips 201 is amplified by the OP amplifier circuit 202 and is then converted into digital image information by the A/D converter 203.

The digital image information obtained in this manner is supplied to the image processing unit 204 and subjected to shading correction and the like and is temporarily stored in the frame memory 205. Subsequently, the digital image information is converted into a data format acceptable by a main body control unit 111 (a control unit of the copier 500 main body) by the output control circuit 206 and is output to the main body control unit 111 via the I/F circuit 107. The controller 100 outputs a timing signal for notification of a timing when the leading end of the document MS reaches the scanning position of the fixed image scanning unit 300 (a timing after which image data is treated as effective data), the light-on signal for the light source, and power supply, for example.

The bundle of the documents MS to be scanned is set on the document placing table 53 such that the first surfaces of the documents MS face upward. The document placing table 53 includes a movable document table **53*b* and a fixed document table 53*a*. The movable document table 53*b* supports the leading end of the documents MS and is swingable in the directions of the arrows a-b in FIG. 1 depending on the thickness of the bundle of the documents MS. The fixed document table 53*a* supports the trailing end of the documents MS. The document placing table 53 further includes side guides (not illustrated) that abut on respective ends of the documents MS in the width direction (the direction perpendicular to the conveying direction of the documents MS and the direction perpendicular to the plane of FIG. 1). When the documents MS are set on the document placing table 53**, the side guides abut on the respective ends of the documents MS in the width direction, thereby positioning the documents MS in the width direction.

A set filler (not illustrated) serving as a lever member is arranged in a swingable manner above the movable document table **53*b*. Setting the documents MS on the document placing table 53 changes the position of the set filler. A document set sensor (not illustrated) detects the change in the position of the set filler, and the document set sensor 63 transmits a detection signal to the controller 100. The detection signal is transmitted from the controller 100 to the main body control unit 111 of the image scanning unit 50 via the I/F circuit 107**.

The fixed document table **53*a* is provided with a plurality of document length sensors (57 and 58**) each formed of a reflective photo sensor or an actuator-type sensor. The reflective photo sensor detects the length of the documents MS in the conveying direction, whereas the actuator-type sensor can detect the length even of one document in the conveying direction. These document length sensors determine the approximation of the length of the documents MS in the conveying direction (the sensors need to be arranged such that they can determine at least whether the length corresponds to the longitudinal direction or the lateral direction of the same document size).

A pick-up roller 80 is arranged above the movable document table **53*b*. The pick-up roller 80 is rotationally driven by driving force transmitted from a feed motor 102. A paper feeding belt 84 and a reverse roller 85 form a separation nip serving as a separating unit. The paper feeding belt 84 and the reverse roller 85 are rotationally driven by driving force transmitted from the feed motor 102**.

The movable document table **53*b* is swung in the directions of the arrows a-b in FIG. 1 by a cam mechanism driven by a bottom plate lifting motor 105. When the set filler and the document set sensor detect that the documents MS are set on the document placing table 53, the controller 100 normally rotate the bottom plate lifting motor 105. The normal rotation of the bottom plate lifting motor 105 causes the movable document table 53***b* to swing in the direction of the arrow a in FIG. 1. This lifts a free end of the movable document table 53*b* (on the left side thereof in FIG. 1). The bundle of the documents MS are lifted together with the free end of the movable document table 53*b*, and thus the uppermost surface of the bundle of the documents MS comes into contact with the pick-up roller 80.

The pick-up roller 80 is rotatably supported at one end of a pick-up bracket 252. The pick-up bracket 252 is swingable in the directions of the arrows c-d in FIG. 1 about a paper feeding unit driving shaft 253 arranged at the other end (on the left side thereof in FIG. 1). The pick-up bracket 252 is swung in the directions of the arrows c-d in FIG. 1 by a cam mechanism driven by a pick-up lifting/lowering motor 101. The swing of the pick-up bracket 252 in the directions of the arrows c-d in FIG. 1 causes the pick-up roller 80 to move in the directions of the arrows c-d in FIG. The ADF 51 includes a table lifting sensor (not illustrated) that detects that the movable document table 53*b* is lifted to push up the pick-up bracket 252.

When the movable document table 53*b* is lifted and the pick-up roller 80 is pushed up by the upper surface of the documents MS on the movable document table 53*b* with the pick-up bracket 252 swinging in the direction of the arrow d in FIG. 1 to descend, the pick-up bracket 252 swings in the direction of the arrow c in FIG. 1 to ascend. The table lifting sensor 59 detects the ascent of the pick-up bracket 252, thereby detecting ascent to the upper limit of the movable document table 53*b*. This stops the pick-up lifting/lowering motor 101 and the bottom plate lifting motor 105, and thus the documents MS are sandwiched between the movable document table 53*b* and the pick-up roller 80.

In other words, the table lifting sensor detects that the bottom plate is lifted to the upper limit and that the upper surface of the bundle of the documents MS is maintained at an appropriate paper feeding height. When the table lifting sensor is turned ON to detect ascent of the pick-up bracket 252, the movable document table 53*b* serving as the bottom plate stops ascending, and paper feeding is repeatedly performed. When the upper surface position of the bundle of the documents MS is lowered by the repetitive paper feeding to turn OFF the detection state of the table lifting sensor, control is repeatedly performed such that the movable document table 53*b* is lifted to turn ON the table lifting sensor again. The control can constantly maintain the upper surface position of the bundle of the documents MS at a height appropriate for paper feeding.

When all the documents MS set on the document placing table 53 are fed, the bottom plate lifting motor 105 is reversely rotated, thereby lowering the movable document table 53*b* to the home position to allow the next bundle of the documents MS to be set. When the movable document table 53*b* is lowered to the home position, a home position sensor 60 detects a filler 553 provided to the lower part of the movable document table 53*b*.

In the present embodiment, both the movable document table 53*b* and the pick-up roller 80 have the lifting/lowering mechanisms. Alternatively, a mechanism that sandwiches the documents MS may be configured such that any one of the movable document table 53*b* and the pick-up roller 80 has the lifting/lowering mechanism.

The user specifies a duplex scanning mode or a single-side scanning mode and presses the copy start button 158 of the operating unit 108 with the documents MS set on the document placing table 53. When the copy start button 158 is pressed, the main body control unit 111 transmits a document feed signal via the I/F circuit 107 to the controller 100 serving as the control unit of the ADF 51. This rotates the feed motor 102 in the normal direction. The normal rotation of the feed motor 102 rotationally drives the pick-up roller 80, thereby picking up several documents MS (preferably one document MS) on the document placing table 53. The direction of rotation of the pick-up roller 80 at this time is a direction to convey the uppermost document MS of the bundle of the documents MS on the document placing table 53 to the separating/feeding unit B.

In the setting of the duplex scanning mode or the single-side scanning mode, the same mode may be set for all the documents MS set on the document placing table 53. Alternatively, different modes may be set for the respective documents MS (the first, the second, . . . , the n-th document MS). Setting of the different modes, for example, is as follows: the duplex scanning mode is set for the first and the tenth documents MS out of ten documents MS; and the single-side scanning mode is set for the other documents MS.

The documents MS fed out by the pick-up roller 80 enters the separating/feeding unit B and is fed into a separation entrance 48 of the separation nip, which is the abutment position of the paper feeding belt 84 and the reverse roller 85. The paper feeding belt 84 is stretched around a paper feeding driving roller 82 and a paper feeding driven roller 83. The paper feeding belt 84 is endlessly moved in the paper feeding direction (the clockwise direction in FIG. 1) by rotation of the paper feeding driving roller 82 along with the normal rotation of the feed motor 102.

The reverse roller 85 is in contact with the lower stretched surface of the paper feeding belt 84. The reverse roller 85 is supplied with driving force to rotate it in the direction (the clockwise direction in FIG. 1) opposite to the paper feeding direction by the normal rotation of the feed motor 102. The surface movement directions of the paper feeding belt 84 and the reverse roller 85 at the separation nip are opposite to each other. This can separate the uppermost document MS of the bundle of the documents MS from the documents MS positioned below the uppermost one, making it possible to feed the uppermost document MS alone.

Specifically, the surface of the paper feeding belt 84 moves in the paper feeding direction at the separation nip, which is the abutment part of the paper feeding belt 84 and the reverse roller 85. While the surface of the reverse roller 85 is caused to move in the direction opposite to the paper feeding direction, the drive transmitting unit of the reverse roller 85 is provided with a torque limiter (not illustrated). If the force of the surface of the reverse roller 85 moving in the paper feeding direction is larger than the largest torque of the torque limiter, the reverse roller 85 rotates in the counterclockwise direction in FIG. 1 such that the surface thereof moves in the paper feeding direction.

The reverse roller 85 is in contact with the paper feeding belt 84 at a predetermined pressure. When the reverse roller 85 is directly in contact with the paper feeding belt 84 or when the reverse roller 85 is in contact with the paper feeding belt 84 with one document MS interposed therebetween (when one document MS alone is nipped by the separation nip), the reverse roller 85 is dragged to rotate by the paper feeding belt 84 or the document MS. In other words, the reverse roller 85 rotates in the counterclockwise direction in FIG. 1, which is the paper feeding direction.

The torque limiter is set such that, when two or more documents MS are nipped by the separation nip, the co-rotational force is made smaller than the largest torque of the torque limiter. Thus, the reverse roller 85 is rotationally driven in the clockwise direction in FIG. 1, which is the direction opposite to the direction of co-rotation. Thus, the reverse roller 85 applies moving force in the direction opposite to the paper feeding direction to the documents MS other than the uppermost document MS out of the documents MS conveyed to the separating/feeding unit B. This pushes back redundant documents MS and separates the uppermost document MS alone from the other documents, thereby preventing multi-feed.

The document MS separated into one sheet by the effect of the paper feeding belt 84 and the reverse roller 85 enters the registration unit C. The document MS is further conveyed by the paper feeding belt 84, and the leading end of the document MS is detected by the abutting sensor 72. Subsequently, the document MS is further conveyed and abuts on a pair of pullout rollers 86 not being rotated. The feed motor 102 that is being driven at this time is driven for a predetermined time from when the leading end is detected by the abutting sensor 72 and then is stopped. Thus, the document MS is conveyed by a predetermined distance from the detection position of the abutting sensor 72. As a result, the paper feeding belt 84 stops conveyance of the document MS with the document MS pressed against the pair of pullout rollers 86 with a predetermined amount of deflection.

When the leading end of the document MS is detected by the abutting sensor 72, the pick-up lifting/lowering motor 101 is rotated. This moves the pick-up roller 80 away from the upper surface of the document MS, and the document MS is conveyed only with the conveying force of the paper feeding belt 84. Thus, the leading end of the document MS enters the nip formed by the upper and lower rollers of the pair of pullout rollers 86, whereby adjustment (skew correction) of the leading end of the document MS is performed.

As described above, the pair of pullout rollers 86 has a function to perform skew correction and conveys the document MS separated and subjected to the skew correction to a pair of intermediate rollers 66. One of the two rollers constituting the pair of pullout rollers 86 is rotationally driven by a pullout motor 113. The driving source of the pair of pullout rollers 86 may be the feed motor 102. In this case, when the feed motor 102 is to be normally rotated, the driving force is transmitted to the paper feeding belt 84 and the reverse roller 85. By contrast, when the feed motor 102 is to be reversely rotated, the driving force is transmitted to the pair of pullout rollers 86. By driving the pair of pullout rollers 86 with the pullout motor 113 serving as an independent driving source as in the present embodiment, it is possible to reduce the start-up time and the shut-down time of the motor. This increases the productivity.

The document MS fed out by the pair of pullout rollers 86 passes through the detection position of the multi-feed detecting mechanism 600. The detection position of the multi-feed detecting mechanism 600 may be provided with a document width sensor that detects the width of the document MS (the length in the direction perpendicular to the plane of FIG. 1). The length of the document MS in the conveying direction is detected from motor pulses based on a time from when the leading end of the document MS is detected by the abutting sensor 72 to when the document MS is no longer detected by the abutting sensor 72 (when the trailing end of the document MS passes by the abutting sensor 72).

The document MS is conveyed by the rotational drive of the pair of pullout rollers 86 and the pair of intermediate rollers 66 and enters the turning unit D in which the document MS is conveyed by the pair of intermediate rollers 66 and the pair of scanning entrance rollers 90. The pair of intermediate rollers 66 is supplied with driving force from both the pullout motor 113 serving as the driving source of the pair of pullout rollers 86 and a scanning entrance motor 114 serving as the driving source of the pair of scanning entrance rollers 90. The rotation velocity of the rollers constituting the pair of intermediate rollers 66 is determined depending on the drive of the motor out of the two motors that causes the rollers to rotate at a faster velocity.

When the pair of pullout rollers 86 and the pair of intermediate rollers 66 rotationally drive to convey the document MS from the registration unit C to the turning unit D in the ADF 51, the conveying speed in the registration unit C is set higher than the conveying speed in the first scan conveying unit E. This reduces the processing time for feeding the document MS into the first scan conveying unit E. At this time, the pair of intermediate rollers 66 rotates using the pullout motor 113 as a driving source.

When the leading end of the document MS is detected by a scanning entrance sensor 67, the pullout motor 113 starts to slow down. In synchronization with this, the scanning entrance motor 114 and a scanning motor 103 are normally rotated. The normal rotation of the scanning entrance motor 114 rotationally drives the pair of scanning entrance rollers 90 in the conveying direction. The normal rotation of the scanning motor 103 rotationally drives a first scanning roller 516, a pair of scanning exit rollers 92, and a pair of second scanning exit rollers 93 in the conveying direction.

As described above, the scanning entrance motor 114 starts to drive, and the pullout motor 113 starts to slow down. As a result, the rotation velocity of the pair of intermediate rollers 66 supplied with driving force from scanning entrance motor 114 exceeds the rotation velocity of the pair of intermediate rollers 66 supplied with driving force from the pullout motor 113 at a certain timing. After the timing, the pair of intermediate rollers 66 rotates using the scanning entrance motor 114 as a driving source. This can make the conveying speed of the document MS equal to that in the first scan conveying unit E before the leading end of the document MS enters the nip formed by the upper and lower rollers of the pair of scanning entrance rollers 90.

When the leading end of the document MS moving from the turning unit D to the first scan conveying unit E is detected by a registration sensor 65, the controller 100 reduces the driving velocity of each motor in a predetermined time. This reduces the conveying speed of the document MS in a predetermined conveyance distance. The controller 100 performs control for temporarily stopping the document MS before a first scanning position 400 at which the first fixed scanning unit 151 scans the image on the first surface of the document MS. Along with the control for the temporary stop, the controller 100 transmits a conveyance stop signal to the main control unit 111 via the I/F circuit 107.

Subsequently, when the controller 100 receives a scanning start signal from the main control unit 111, the controller 100 starts to drive the scanning entrance motor 114 and the scanning motor 103. At this time, the controller 100 controls the drive of the scanning entrance motor 114 and the scanning motor 103 so as to increase the conveying speed of the document MS that has been stopped to a predetermined conveying speed before the leading end of the document MS reaches the first scanning position 400. This enables the document MS to be conveyed toward the first scanning position 400 while increasing the conveying speed.

Subsequently, the timing is detected at which the leading end of the document MS reaches the first scanning position 400, which is derived based on the pulse count of the scanning entrance motor 114. At the detected timing, the controller 100 transmits a gate signal indicating an effective image area in the sub-scanning direction of the first surface of the document MS to the main control unit 111. The transmission of the gate signal is continued until the trailing end of the document MS passes out of the first scanning position 400. Thus, the first fixed scanning unit 151 scans the first surface of the document MS.

The upper surface of the left scale 156 is inclined such that the left end is lower than the right end. With this structure, the leading end of the document MS that has passed through the first scanning position 400 is guided upward by the inclination of the left scale 156 and is conveyed to the nip of the pair of scanning exit rollers 92. To increase the productivity, the following control may be performed: the conveying speed is reduced to a predetermined speed at the pair of scanning entrance rollers 90; the document MS is not temporarily stopped before the first scanning position 400; and the conveying speed is increased to a predetermined scanning speed until the document MS reaches the first scanning position 400. At this time, a difference in linear velocity is generated at the pair of scanning entrance rollers 90. This generates deflection in the document MS at the pair of scanning entrance rollers 90 and the upstream thereof, making it possible to perform skew correction.

The document MS that has passed through the first scan conveying unit E passes through the nip of the pair of scanning exit rollers 92, and the leading end thereof is detected by a discharging sensor 61. Subsequently, the document MS passes through the second scan conveying unit F and is conveyed to the discharging unit G. In the single-side scanning mode to scan one surface (the first surface) of the document MS alone, the second fixed scanning unit 95 need not scan the second surface of the document MS. Therefore, the detection of the front edge of the document by the discharging sensor 61 causes the discharging motor 104 to start normal rotational driving, thereby rotationally driving an ejecting roller on the upper side in FIG. 1 of a pair of document ejecting rollers 94 in the counterclockwise direction in FIG. 1.

In addition, based on a pulse count of the discharging motor 104 from when the discharging sensor 61 has detected the front edge of the document MS, the time is calculated at which the trailing end of the document MS will pass out of a nip of the document ejecting rollers 94. Based on the calculation result, the driving velocity of the discharging motor 104 starts to be reduced at a timing immediately before the trailing end of the document MS passes out of the nip of the pair of document ejecting rollers 94. The control for reducing the velocity enables the document MS to be ejected at an appropriate speed to keep the document MS from flying out of the document stacking table 55.

By contrast, in the duplex scanning mode to scan both surfaces (the first surface and the second surface) of the document MS, the following control is performed. After the discharging sensor 61 detects the leading end of the document MS, the timing at which the leading end reaches the second fixed scanning unit 95 is calculated based on the pulse count of the scanning motor 103. Then, at the calculated time, the controller 100 sends, to the main control unit 111, a gate signal that indicates an effective image area in the sub-scanning direction on the second surface of the document MS. The transmission of the gate signal is continued until the trailing end of the document MS passes out of a second scanning position of the second fixed scanning unit 95. Thus, the second fixed scanning unit 95 scans the second surface of the document MS.

The second fixed scanning unit 95 serving as a scanning unit is a contact image sensor (CIS). In order to prevent a longitudinal scanned steak from being formed due to adherence, onto the scanning surface, of paste-like foreign matter attached on the document MS, a coating process is applied to the scanning surface. A second scanning roller 96 is arranged in a position facing the second fixed scanning unit 95 with the document conveying path, through which the document MS is conveyed, interposed therebetween. The second scanning roller 96 serves as a document supporting unit that supports the document MS from the non-scanning surface side (first surface side). The second scanning roller 96 prevents the document MS from floating in the second scanning position of the second fixed scanning unit 95 and serves as a reference white portion for acquiring shading data in the second fixed scanning unit 95.

The present embodiment includes two fixed image scanning units 300 each serving as a conveyed document scanning unit that scans an image on the conveyed document MS, which are the first fixed scanning unit 151 and the second fixed scanning unit 95. The configuration that scans images on both surfaces of the document MS does not necessarily include the two fixed image scanning units 300. One fixed image scanning unit 300 may switch back the document MS whose front surface is already scanned and then scan the back surface when the document MS passes through the scanning position of the fixed image scanning unit 300 again.

When the document MS is jammed on the upstream of the document conveying path in the ADF 51, the user opens the paper feeding unit cover 98 to remove the jammed document MS. The ADF 51 includes a paper feeding unit cover interlock switch 529 serving as a detecting unit that detects opening and closing of the paper feeding unit cover 98.

Figure 10A:
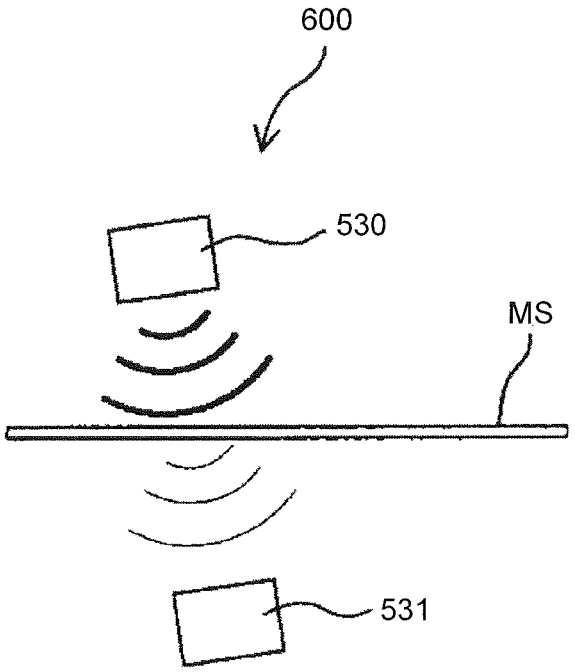
FIG. 10A and FIG. 10B are views for explaining a multi-feed detecting mechanism and FIG. 10A is a view for explaining the state where one document is present at a detection position.
Figure 10B:
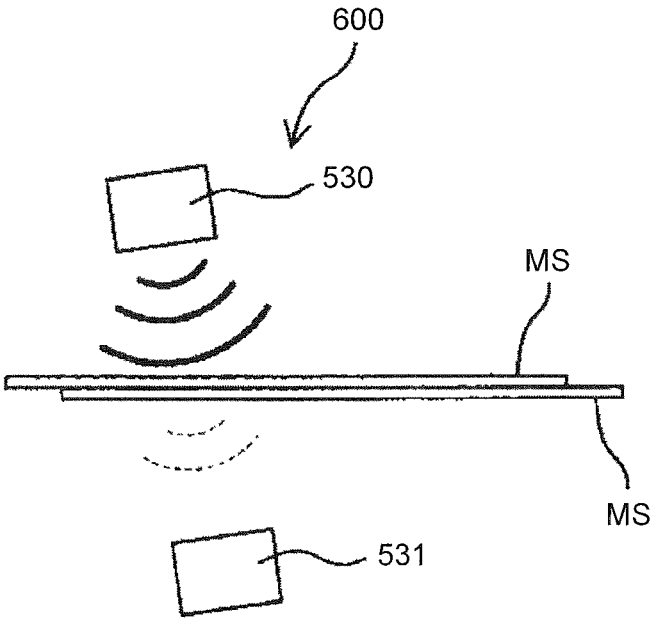

The multi-feed detecting mechanism 600 will now be described. FIGS. 10A and 10B are views for explaining the multi-feed detecting mechanism 600. FIG. 10A is a view for explaining the state where one document MS is present at a detection position of the multi-feed detecting mechanism 600. FIG. 10B is a view for explaining the state where two documents MS are present at the detection position of the multi-feed detecting mechanism 600. As illustrated in FIGS. 10A and 10B, the multi-feed detecting mechanism 600 includes an ultrasonic transmitting element 530 and an ultrasonic receiving element 531.

When one document MS is present as illustrated in FIG. 10A, ultrasonic waves transmitted from the ultrasonic transmitting element 530 pass through the air, the document MS, and the air in order and reach the ultrasonic receiving element 531 on the receiving side. When two documents MS are present as illustrated in FIG. 10B, ultrasonic waves transmitted from the ultrasonic transmitting element 530 pass through the air, the document MS, the air, the document MS, and the air in order and reach the ultrasonic receiving element 531 on the receiving side. Because the number of documents MS through which the ultrasonic waves pass is larger in the case of the two documents MS than in the case of the one document MS, the attenuation amount is larger, thereby reducing the level of the ultrasonic waves received by the ultrasonic receiving element 531. The multi-feed detecting mechanism 600 determines whether multi-feed occurs based on a difference in level of the ultrasonic waves received by the ultrasonic receiving element 531 between the case of one document MS and the case of two documents MS.

Figure 11:
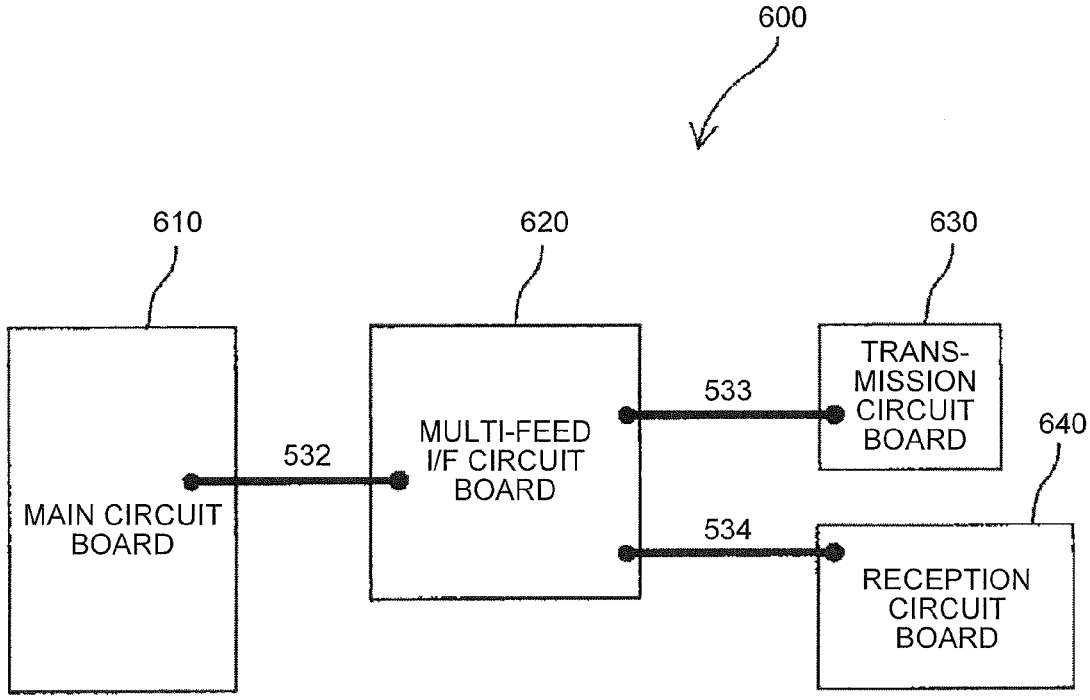
FIG. 11 is a block diagram of a control system of the multi-feed detecting mechanism.

FIG. 11 is a block diagram of a control system of the multi-feed detecting mechanism 600. As illustrated in FIG. 11, the multi-feed detecting mechanism 600 includes four circuit boards, which are a main circuit board 610, a multi-feed I/F circuit board 620, a transmission circuit board 630, and a reception circuit board 640. The main circuit board 610 and the multi-feed I/F circuit board 620 are connected by a first multi-feed detection line 532. The multi-feed I/F circuit board 620 and the transmission circuit board 630 are connected by a second multi-feed detection line 533. The multi-feed I/F circuit board 620 and the reception circuit board 640 are connected by a third multi-feed detection line 534.

Figure 12:
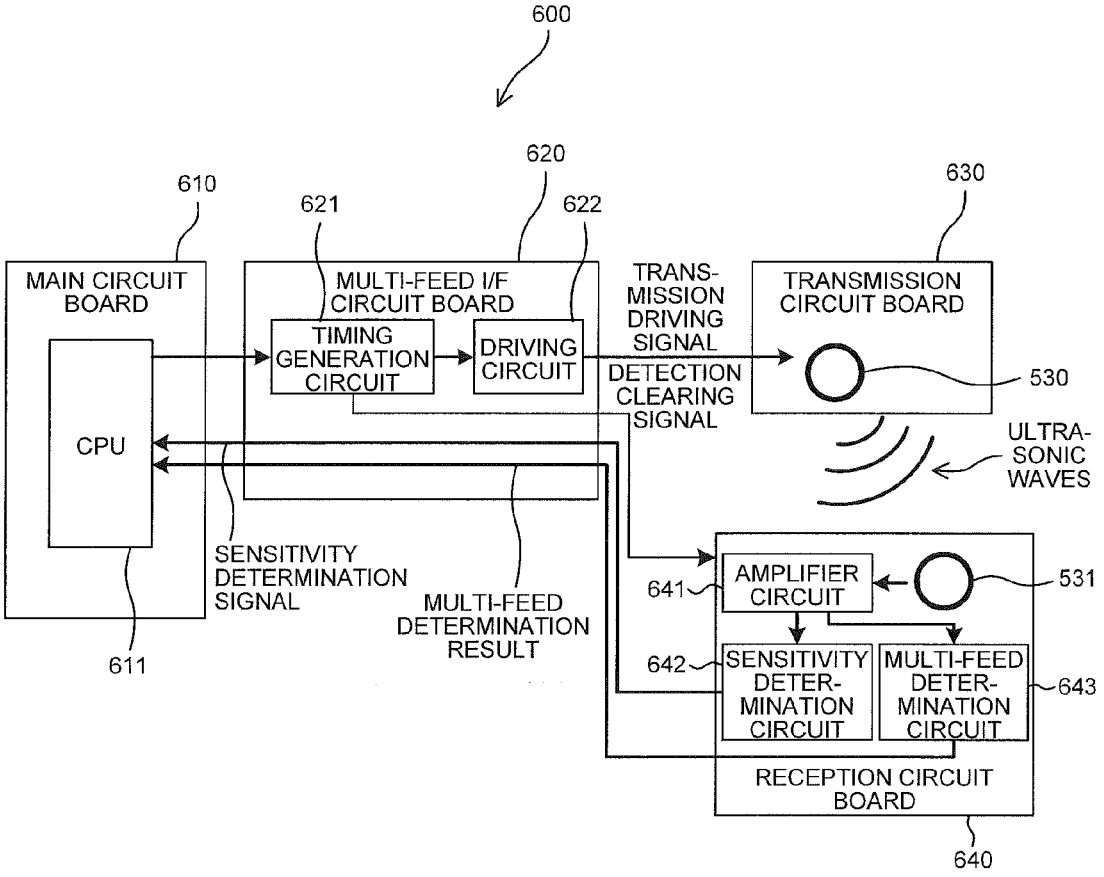
FIG. 12 is a view for explaining transmission and reception of signals between circuit boards via multi-feed detection lines in the control system of the multi-feed detecting mechanism illustrated in FIG. 11.

FIG. 12 is a view for explaining transmission and reception of signals between the circuit boards (610, 620, 630, and 640) via the multi-feed detection lines (532 to 534) in the control system of the multi-feed detecting mechanism 600 illustrated in FIG. 11. As illustrated in FIG. 12, the transmission circuit board 630 includes the ultrasonic transmitting element 530, whereas the reception circuit board 640 includes the ultrasonic receiving element 531. The reception circuit board 640 further includes an amplifier circuit 641 and a multi-feed determination circuit 643. The amplifier circuit 641 amplifies a signal output from the ultrasonic receiving element 531. The multi-feed determination circuit 643 is used to determine whether multi-feed occurs. The reception circuit board 640 further includes a sensitivity determination circuit 642 that determines whether the sensitivity of the ultrasonic receiving element 531, in which variation between elements arises in the manufacturing process, is high or low.

In the ultrasonic receiving element 531, an output voltage changes depending on the level of the received ultrasonic waves. As the level of the ultrasonic waves increases, the output voltage increases; whereas as the level of the ultrasonic waves decreases, the output voltage decreases. The amplifier circuit 641 amplifies the changes in voltage output from the ultrasonic receiving element 531 to a sufficient level to enable multi-feed determination and outputs the amplified changes. The amplifier circuit 641 has a function to retain its outputs obtained by the amplification.

Figure 13:
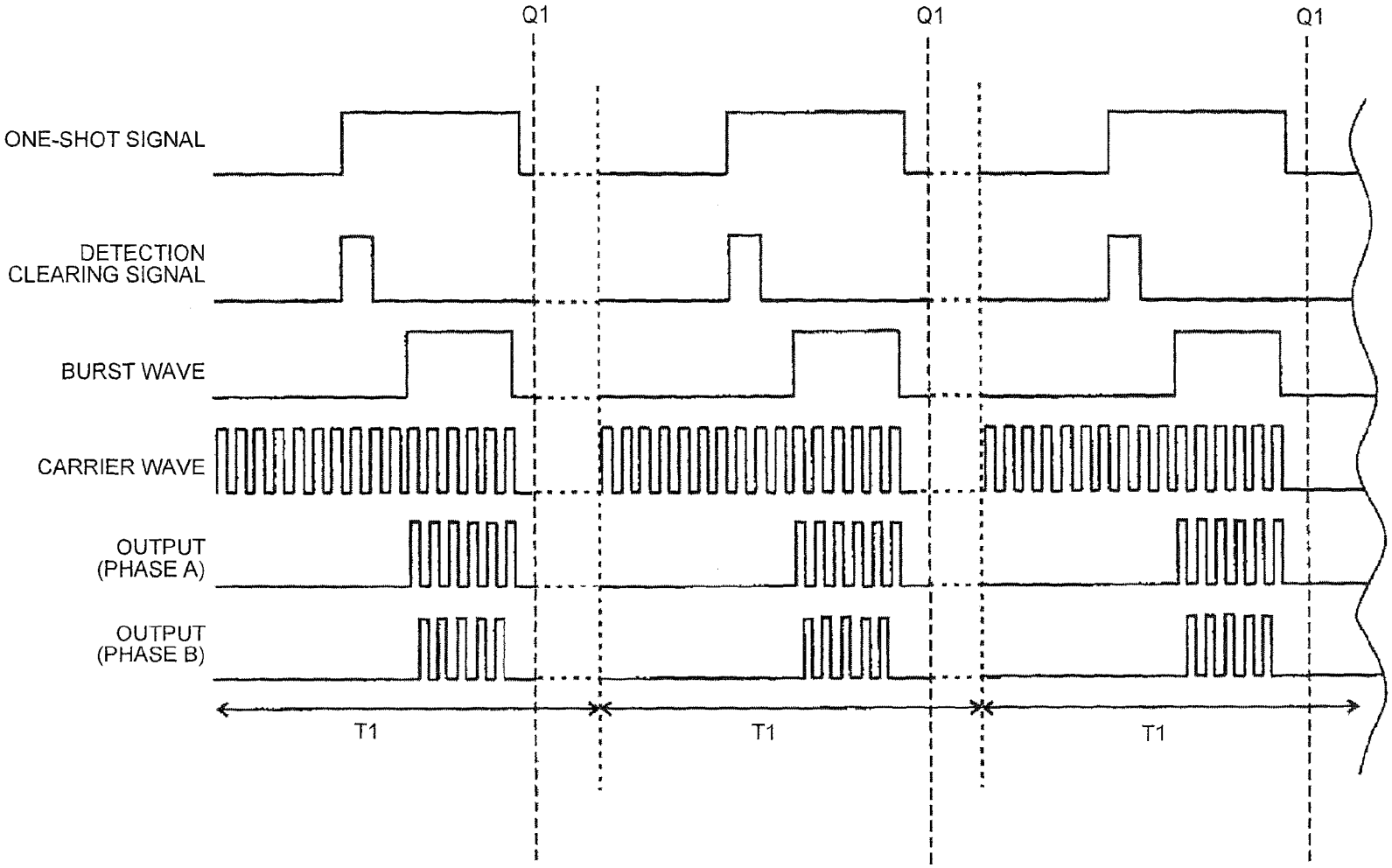
FIG. 13 is a timing chart of multi-feed detection.

FIG. 13 is a timing chart of multi-feed detection. Q1 in FIG. 13 indicates a timing for determining whether the level of a signal used for multi-feed detection by the multi-feed determination circuit 643 reaches a threshold. T1 in FIG. 13 indicates a period with which the multi-feed determination circuit 643 determines one time whether the reception signal reaches the threshold. For every multi-feed determination in the present embodiment, the multi-feed determination circuit 643 determines ten times at the most whether the reception signal reaches the threshold. If the number of times of the reception signal falling below the threshold reaches twice in the ten times of determination, the multi-feed determination circuit 643 determines that multi-feed occurs.

The attenuation amount of the ultrasonic waves is larger and the reception level is lower in the case of two documents MS than in the case of one document MS. By setting a threshold between the reception levels in the case of one document MS and in the case of two documents MS, it is possible to perform multi-feed detection. Because multi-feed detection is performed on the conveyed document MS, the attenuation amount of the ultrasonic waves passing therethrough may possibly increase depending on the state of the conveyed document MS, such as deflection in the document MS, despite no multi-feed occurring. To address this, the present embodiment determines that multi-feed occurs when the number of times that the output of the reception signal falls below the threshold reaches two in the ten times of determination.

To perform multi-feed detection, a central processing unit (CPU) 611 of the main circuit board 610 transmits three signals to the multi-feed I/F circuit board 620, which are a "one-shot signal", a "burst signal", and a "carrier signal". The "one-shot signal" is a signal for setting a valid period to perform multi-feed detection. While the level of the "one-shot signal" is "high", the multi-feed determination circuit 643 receives a signal used for multi-feed detection in the multi-feed detecting mechanism 600. In other words, when the level of the "one-shot signal" is changed from "low" to "high", the multi-feed determination circuit 643 starts to receive a signal from the amplifier circuit 641. When the level of the "one-shot signal" is changed from "high" to "low", the multi-feed determination circuit 643 stops receiving a signal from the amplifier circuit 641 and determines whether the reception signal reaches the threshold.

The "burst signal" and the "carrier signal" are used in combination as a trigger for the ultrasonic transmitting element 530 to transmit ultrasonic waves. The "carrier signal" is used to generate a signal pulse of the ultrasonic waves transmitted by the ultrasonic transmitting element 530. The "carrier signal" continues to be transmitted at a "high" level and a "low" level in predetermined cycles from a timing earlier than the timing at which the ultrasonic transmitting element 530 actually transmits the ultrasonic waves. By contrast, the "burst signal" is used when the ultrasonic transmitting element 530 actually transmits the ultrasonic waves. The ultrasonic transmitting element 530 included in the transmission circuit board 630 transmits the ultrasonic waves at the timing when the levels of these two signals are "high". However, inverse conversion in relation to the pulse phase is performed even when the level of the carrier signal is "low". Therefore, the ultrasonic waves are transmitted while the level of the burst signal is "high".

The following describes an operation in the multi-feed I/F circuit board 620. Based on the signals (the "one-shot signal", the "burst signal", and the "carrier signal") transmitted from the main circuit board 610, signals to be transmitted to the transmission circuit board 630 and the reception circuit board 640 are generated. A timing generation circuit 621 in the multi-feed i/F circuit board 620 receives a signal transmitted from the main circuit board 610 via the first multi-feed detection line 532. As a signal to be transmitted to the transmission circuit board 630, a transmission driving signal is first generated with the combination of the "burst signal" and the "carrier signal", which are received by the timing generation circuit 621. The multi-feed I/F circuit board 620 then transmits the transmission driving signal to the transmission circuit board 630 from a driving circuit 622 via the second multi-feed detection line 533. The transmission circuit board 630 uses the transmission driving signal generated with the combination of the "burst signal" and the "carrier signal", thereby transmitting an ultrasonic signal from the ultrasonic transmitting element 530 to the ultrasonic receiving element 531 of the reception circuit board 640.

An "output (phase A)" and an "output (phase B)" are the transmission driving signals each generated with the combination of the "burst signal" and the "carrier signal". The "output (phase A)" is a signal having the same phase as that of the carrier signal, whereas the "output (phase B)" is a signal having a phase inverted with respect to that of the carrier signal.

A signal to be transmitted from the multi-feed I/F circuit board 620 to the reception circuit board 640 is a detection clearing signal generated with the combination of the "one-shot signal". In the reception circuit board 640, the amplifier circuit 641 amplifies a signal received by the ultrasonic receiving element 531 as a reception signal, and the multi-feed determination circuit 643 determines whether the reception signal reaches the threshold. The reception circuit board 640 transmits a signal of a multi-feed determination result based on the results of the multiple times of determination to the main circuit board 610. After receiving the reception signal from the ultrasonic receiving element 531, the amplifier circuit 641 retains the value of the reception signal until the amplifier circuit 641 receives another reception signal. When the reception circuit board 640 receives the detection clearing signal from the multi-feed I/F circuit board 620, the value of the reception signal retained in the amplifier circuit 641 is reset.

The following describes the sensitivity determination circuit 642 included in the reception circuit board 640. The sensitivity determination circuit 642 is used to select control software that controls output of the transmission driving signal in a pre-shipment inspection of the multi-feed detecting mechanism 600 included in the ADF 51 before shipment. In the ultrasonic receiving element 531, variation in sensitivity occurs in the manufacturing process. As a result, even if the output of the ultrasonic signal transmitted from the ultrasonic transmitting element 530 is at the same level, variation occurs in magnitude of the voltage the reception signal output from the ultrasonic receiving element 531. In other words, some ultrasonic receiving elements 531 have low sensitivity and output the reception signal of a relatively low voltage when receiving an ultrasonic signal of a certain output, and others have high sensitivity and output the reception signal of a relatively high voltage when receiving an ultrasonic signal of the same output.

If the output of the transmission driving signal and the threshold of the multi-feed determination circuit 643 are set based on the ultrasonic receiving element 531 having low sensitivity, the following problem may possibly occur. When the ultrasonic receiving element 531 having high sensitivity is used, the reception signal possibly exceeds the threshold despite multi-feed occurring, resulting in determination that no multi-feed occurs. To address this, the multi-feed detecting mechanism 600 according to the present embodiment includes control software for the transmission driving signal in the case of using ultrasonic receiving element 531 having low reception sensitivity and control software for the transmission driving signal in the case of using ultrasonic receiving element 531 having high reception sensitivity. In the control software to be used in the case of using the ultrasonic receiving element 531 having high reception sensitivity, the output of the transmission driving signal is set smaller. In the default settings of the multi-feed detecting mechanism 600 prior to the pre-shipment inspection, the multi-feed detecting mechanism 600 is configured to use the control software to be used in the case of the ultrasonic receiving element 531 having low reception sensitivity.

The sensitivity determination circuit 642 determines whether the signal level of the reception signal output from the ultrasonic receiving element 531 via the amplifier circuit 641 reaches the predetermined threshold. The threshold is set such that, when the ultrasonic receiving element 531 outputs a reception signal at a certain level, the result of determining whether the reception signal reaches the threshold is the same as the determination result of the multi-feed determination circuit 643. If the level of the reception signal reaches the threshold, the sensitivity determination circuit 642 transmits a signal "high" to the main circuit board 610. By contrast, if the level of the reception signal is below the threshold, the sensitivity determination circuit 642 transmits a signal "low" to the main circuit board 610.

The sensitivity determination circuit 642 and the multi-feed determination circuit 643 are the same in that both determine whether the signal level of the reception signal reaches the threshold. The multi-feed determination circuit 643 determines whether the signal level of the reception signal fails below the threshold twice in ten times of determination at the most and transmits the multi-feed determination result to the main circuit board 610. By contrast, the sensitivity determination circuit 642 transmits, every time it makes determination of whether the signal level of the reception signal reaches the threshold, the determination result to the main circuit board 610. The sensitivity determination circuit 642 makes simpler determination, making it possible to transmit the changes in the output from the amplifier circuit 641 to the main circuit board 610 with high responsivity.

In the pre-shipment inspection, multi-feed detection is performed with a piece of inspection paper placed at the detection position of the multi-feed detecting mechanism 600. If a determination result "multi-feed" is obtained, that is an error. By contrast, if a determination result "no multi-feed" is obtained with the piece of inspection paper placed at the detection position, multi-feed detection is then performed by placing two pieces of inspection paper at the detection position. If a determination result "multi-feed" is obtained at this time, it is determined that the multi-feed detecting mechanism 600 has no problem, and the pre-shipment inspection is terminated. By contrast, a determination result "no multi-feed" is obtained with the two pieces of inspection paper placed, the main circuit board 610 checks an input result of a main input port to which a signal is input from the sensitivity determination circuit 642. If the input result is "low", it is determined the multi-feed determination circuit 643 has abnormality. By contrast, if the input result is "high", it is determined that the ultrasonic receiving element 531 included in the multi-feed detecting mechanism 600 has high sensitivity.

If it is determined that the ultrasonic receiving element 531 has high sensitivity, the setting to use the control software in the case of using the ultrasonic receiving element 531 having low sensitivity in the default settings is switched to the setting to use the control software in the case of using the ultrasonic receiving element 531 having high sensitivity. After switching to the setting to use the control software in the case of using the ultrasonic receiving element 531 having high sensitivity, multi-feed detection is performed again with a piece of inspection paper and two pieces of inspection paper placed at the detection position. If a determination result "no multi-feed" is obtained with a piece of inspection paper placed and a determination result "multi-feed" is obtained with two pieces of inspection paper placed at the detection position, the pre-shipment inspection is terminated.

The following describes characteristic parts according to the present embodiment. The multi-feed detecting mechanism 600 of the ADF 51 includes the transmission circuit board 630 that transmits ultrasonic waves and the reception circuit board 640 that receives the ultrasonic waves transmitted by the transmission circuit board 630. The transmission circuit board 630 and the reception circuit board 640 face each other with the document conveying path 54 interposed therebetween. The multi-feed detecting mechanism 600 further includes the main circuit board 610 and the multi-feed i/F circuit board 620. The main circuit board 610 serves as a detection signal control unit that controls the transmission circuit board 630 and the reception circuit board 640. The ADF 51 performs a multi-feed detection initial operation, which is multi-feed failure detection control for detecting whether a failure occurs in the multi-feed detecting mechanism 600. The ADF 51 performs the multi-feed detection initial operation regardless of the presence of the document MS at the multi-feed detection position between the ultrasonic transmitting element 530 of the transmission circuit board 630 and the ultrasonic receiving element 531 of the reception circuit board 640.

If a failure occurring in the multi-feed detecting mechanism 600 is a failure that can be detected even when a sheet material is present at the multi-feed detection position between the ultrasonic transmitting element 530 and the ultrasonic receiving element 531 in the document conveying path 54, it is possible to detect the failure even when a sheet material is present in the conveying path. Failures in the multi-feed detecting mechanism 600 include failures that cannot be detected when the document MS is present at the multi-feed detection position and failures that can be detected even when the document MS is present at the multi-feed detection position.

Examples of the failures that cannot be detected when the document MS is present at the multi-feed detection position include a failure in the line from the multi-feed I/F circuit board 620 to the transmission circuit board 630 and a failure in the transmission circuit board 630. To check whether these units operate normally, the following method may be performed. The transmission circuit board 630 performs control for transmitting ultrasonic waves at a predetermined output level, and the determination is made based on whether a reception signal of the reception circuit board 640 that receives the transmitted ultrasonic waves corresponds to a reception signal obtained when the reception circuit board 640 receives ultrasonic waves at the predetermined output level. If a failure occurs in the line from the multi-feed I/F circuit board 620 to the transmission circuit board 630 or in the transmission circuit board 630, the transmission circuit board 630 cannot transmit ultrasonic waves at the predetermined output level. As a result, the reception signal of the reception circuit board 640 does not correspond to that obtained when the reception circuit board 640 receives ultrasonic waves at the predetermined output level. Thus, it can be considered that some failure occurring in the multi-feed detecting mechanism 600 is detected.

When the document MS is present at the multi-feed detection position, however, the ultrasonic waves transmitted from the transmission circuit board 630 are attenuated when passing through the document MS. Even if the transmission circuit board 630 transmits the ultrasonic waves at the predetermined output level, the reception signal of the reception circuit board 640 does not correspond to that obtained when the reception circuit board 640 receives ultrasonic waves at the predetermined output level. Despite no failure occurring in the multi-feed detecting mechanism 600, it is detected that some failure occurs in the multi-feed detecting mechanism 600. Thus, a failure in the line from the multi-feed I/F circuit board 620 to the transmission circuit board 630 or in the transmission circuit board 630 cannot be detected when the document MS is present at the multi-feed detection position.

By contrast, examples of the failures that can be detected even when the document MS is present at the multi-feed detection position include a failure in the line connecting the reception circuit board 640, the multi-feed I/F circuit board 620, and the main circuit board 610. Even when no ultrasonic wave is received or when the output of the received ultrasonic waves is small, the reception circuit board 640 generates a reception signal for communicating to the multi-feed I/F circuit board 620 and the main circuit board 610 that no ultrasonic wave is received or that the output of the received ultrasonic waves is small. Thus, even when the ultrasonic waves transmitted from the transmission circuit board 630 are attenuated by the document MS or when no ultrasonic wave is transmitted from the transmission circuit board 630, the reception circuit board 640 generates some reception signal. The generated reception signal is then transmitted to the main circuit board 610 via the multi-feed I/F circuit board 620.

If a failure occurs in the line between the reception circuit board 640 and the main circuit board 610 in this configuration, the reception signal is not transmitted to the main circuit board 610. As a result, no reception signal is transmitted to the detection signal control unit at a timing when a reception signal is supposed to be transmitted to the main circuit board 610. Thus, it is detected that some failure occurs in the line between the reception circuit board 640 and the main circuit board 610. At this time, regardless of the presence of the document MS at the multi-feed detection position, no reception signal is transmitted to the main circuit board 610 if a failure occurs in the line, and a reception signal is transmitted to the main circuit board 610 if no failure occurs in the line. Thus, such a failure can be detected even when the document MS is present at the multi-feed detection position.

Some failures in the multi-feed detecting mechanism 600 cannot be detected when the document MS is present at the multi-feed detection position. Thus, the conventional technology uniformly performs multi-feed failure detection control for detecting a failure in a multi-feed detecting mechanism only when no document is present at a multi-feed detection position. With this configuration, however, even in a case where only a failure occurs that can be detected even when the document MS is present at the multi-feed detection position, the user is first notified, when a document is present at the multi-feed detection position, that a document is present at the multi-feed detection position. Although the user expects scanning of a document to be enabled immediately by removing the document MS, the user ends up needing to ask a service person to come after removing the document.

By contrast, the ADF 51 according to the present embodiment performs the multi-feed initial operation, which is multi-feed failure detection control, regardless of the presence of the document MS at the multi-feed detection position. In a case where only a failure occurs that can be detected even when the document MS is present at the multi-feed detection position, the ADF 51 can detect the failure in the multi-feed detecting mechanism 600 even if the operation to remove the document MS at the multi-feed detection position is not performed. By displaying the detected failure on a display unit of the operating unit 108, the ADF 51 can notify the user that the failure occurs in the multi-feed detecting mechanism 600 even when the document MS is present in the document conveying path 54.

The ADF 51 according to the present embodiment can detect not only a failure in the line between the reception circuit board 640 and the main circuit board 610 but also a failure by which the output of the voltage from the ultrasonic receiving element 531 is fixed at a high level. The present embodiment uses the output signal from the sensitivity determination circuit 642, instead of the output signal from the multi-feed determination circuit 643, in the multi-feed detection initial operation. The configuration that performs the multi-feed detection initial operation regardless of the presence of the document MS at the multi-feed detection position is also applicable to a configuration that uses the output signal from the multi-feed determination circuit 643.

Figure 14:
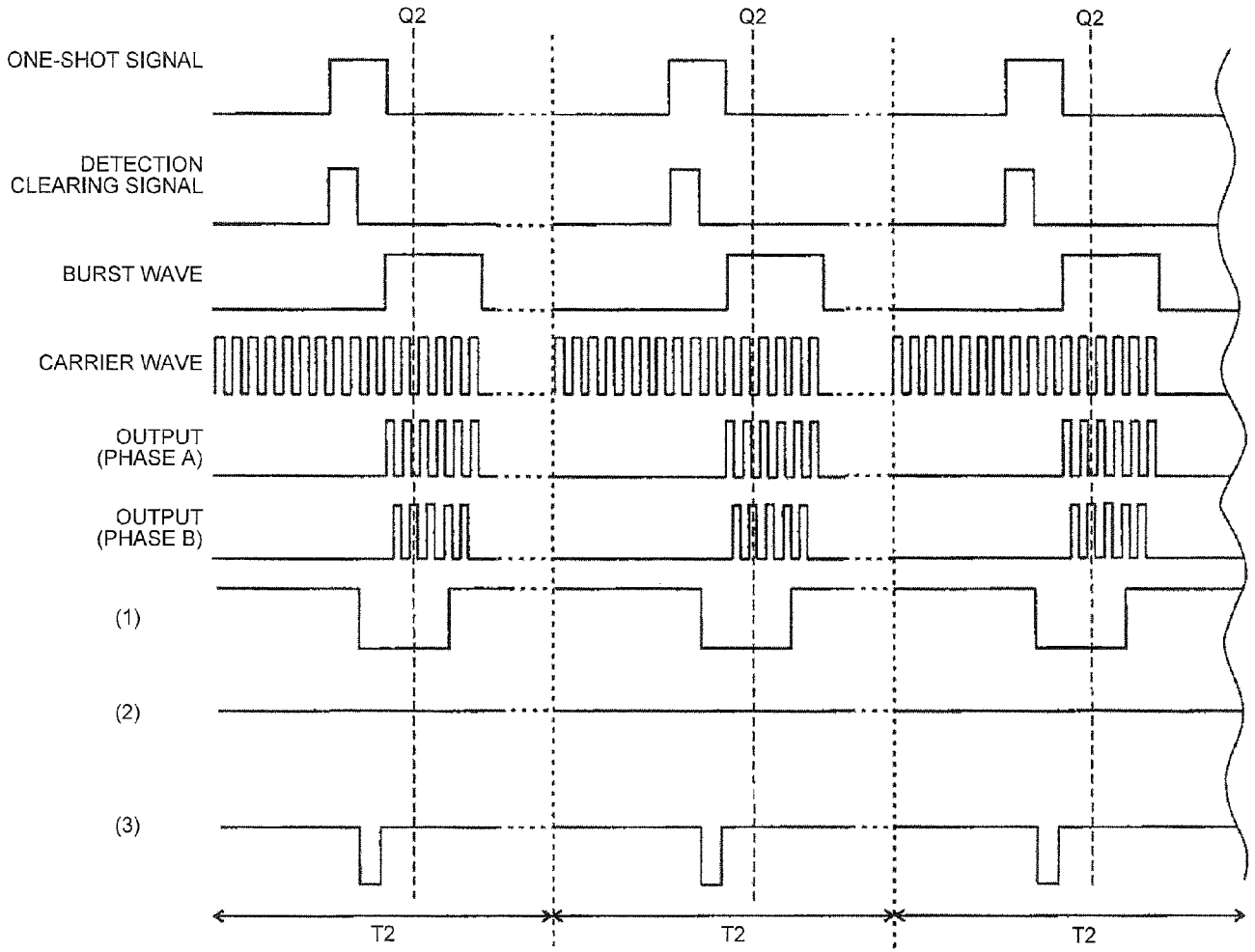
FIG. 14 is a timing chart of a multi-feed detection initial operation.

FIG. 14 is a timing chart of the multi-feed detection initial operation. The rows (1) to (3) in FIG. 14 indicate temporal change of a sensitivity determination signal received by the main circuit board 610 when a failure occurs and when no failure occurs. The row (1) indicates the case where no failure occurs in the multi-feed detecting mechanism 600. The row (2) indicates the case where a failure occurs in the line between the reception circuit board 640 and the main circuit board 610. The row (3) indicates the case where a failure occurs by which the output of the voltage from the ultrasonic receiving element 531 is fixed at a high level.

Q2 in FIG. 14 indicates a timing at which the main circuit board 610 checks the sensitivity determination signal transmitted from the sensitivity determination circuit 642 to determine whether a failure occurs. As illustrated in FIG. 14, the main circuit board 610 checks the sensitivity determination signal at a timing after the one-shot signal is turned ON and then OFF and the burst signal is turned ON. The main circuit board 610 checks the sensitivity determination signal at a timing after the burst signal is turned ON and before it is turned OFF. Thus, the present embodiment determines whether a failure occurs in the multi-feed detecting mechanism 600 after the ultrasonic transmitting element 530 starts to transmit ultrasonic waves.

An I/F input port is configured to output that a sensitivity determination signal of "high" is input in the default settings, the I/F input port being an input port through which the sensitivity determination signal transmitted from the sensitivity determination circuit 642 is input to the multi-feed I/F circuit board 620. The main input port through which the sensitivity determination signal is input to the main circuit board 610 is also configured to output that a sensitivity determination signal of "high" is input in the default settings. Before the multi-feed detection initial operation is performed, for example, when the power is turned on, the I/F input port and the main input port are reset such that the output thereof is as in the default settings. Thus, the output value of the sensitivity determination signal is "high" from the initial state as illustrated in the rows (1) to (3) in FIG. 14.

If the first multi-feed detection line 532 is connected, the "one-shot signal" is transmitted from the main circuit board 610 to the multi-feed I/F circuit board 620. If the third multi-feed detection line 534 is connected, the "detection clearing signal" is transmitted from the multi-feed I/F circuit board 620 to the amplifier circuit 641 of the reception circuit board 640. The amplifier circuit 641 that receives the detection clearing signal resets the retained signal information. As a result, the level of the signal output to the sensitivity determination circuit 642 is lowered to a signal level lower than the threshold in the sensitivity determination circuit 642. Thus, the sensitivity determination circuit 642 outputs a sensitivity determination signal of "low".

If the third multi-feed detection line 534 and the first multi-feed detection line 532 are connected, the output at the I/F input port and the main input port is switched from "high" to "low". This turns the sensitivity determination signal in the main circuit board 610 to "low" as indicated by the row (1) in FIG. 14. Because the transmission driving signals, such as the "output (phase A)" and the "output (phase B), are transmitted, the ultrasonic transmitting element 530 outputs ultrasonic waves. This causes the ultrasonic receiving element 531 to start to output a reception signal. However, it takes a certain time for the amplifier circuit 641 to amplify the reception signal to a predetermined amplification width from when the amplifier circuit 641 starts to receive the reception signal. As a result, the sensitivity determination signal remains "low" at the timing Q2 when the main circuit board 610 determines whether a failure occurs.

Subsequently, the reception signal is amplified to the predetermined amplification width, whereby the level of the signal is raised to a signal level higher than the threshold in the sensitivity determination circuit 642. Thus, the sensitivity determination circuit 642 outputs a sensitivity determination signal of "high", and the sensitivity determination signal in the main circuit board 610 is turned "high". As described above, when no failure occurs, the sensitivity determination signal is "low" at the timing Q2 when the main circuit board 610 determines whether a failure occurs. When the document MS is present at the multi-feed detection position, the signal level of the ultrasonic waves received by the ultrasonic receiving element 531 is small. This may possibly prevent the sensitivity determination signal output by the sensitivity determination circuit 642 after the timing Q2 from being turned "high". Because the sensitivity determination signal is "low" at the timing Q2 even if the document MS is present, the determination of whether a failure occurs receives no effect.

By contrast, when any one of the first multi-feed detection line 532 and the third multi-feed detection line 534 is unconnected, no sensitivity determination signal from the sensitivity determination circuit 642 is input to the main input port. As a result, the output of the main input port remains "high", which is the default settings, as indicated by the row (2) in FIG. 14. When any one of the first multi-feed detection line 532 and the third multi-feed detection line 534 is unconnected, the sensitivity determination signal is "high" at the timing Q2 when the main circuit board 610 determines whether a failure occurs. Even when the document MS is present at the multi-feed detection position, it is still the same that no sensitivity determination signal from the sensitivity determination circuit 642 is input to the main input port. As a result, the sensitivity determination signal is "high" at the timing Q2 when the main circuit board 610 determines whether a failure occurs. Thus, the presence of the document MS has no effect on the determination of whether a failure occurs.

When a failure occurs by which the output of the voltage from the ultrasonic receiving element 531 is fixed at a high level, a reception signal having a large signal level is input into the amplifier circuit 641 from the ultrasonic receiving element 531 as soon as the signal information retained in the amplifier circuit 641 is reset by the detection clearing signal. Once the signal information in the amplifier circuit 641 is reset, the sensitivity determination circuit 642 outputs a sensitivity determination signal of "low", whereby the output of the main input port is switched from "high" to "low".

Because the reception signal from the ultrasonic receiving element 531 is at a signal level exceeding the threshold of the sensitivity determination circuit 642 even if not being amplified by the amplifier circuit 641, the sensitivity determination circuit 642 immediately outputs a sensitivity determination signal of "high". This switches the output of the main input port from "low" to "high", and thus the sensitivity determination signal is "high" at the timing Q2 when the main circuit board 610 determines whether a failure occurs. Even when the document MS is present at the multi-feed detection position, it is still the same that the sensitivity determination circuit 642 immediately outputs a sensitivity determination signal of "high". As a result, the sensitivity determination signal is "high" at the timing Q2 when the main circuit board 610 determines whether a failure occurs. Thus, the presence of the document MS has no effect on the determination of whether a failure occurs.

In the present embodiment, by detecting that the sensitivity determination signal is "high" at the timing Q2 when the main circuit board 610 determines whether a failure occurs, it is possible to detect that a failure occurs in the multi-feed detecting mechanism 600.

Figure 15:
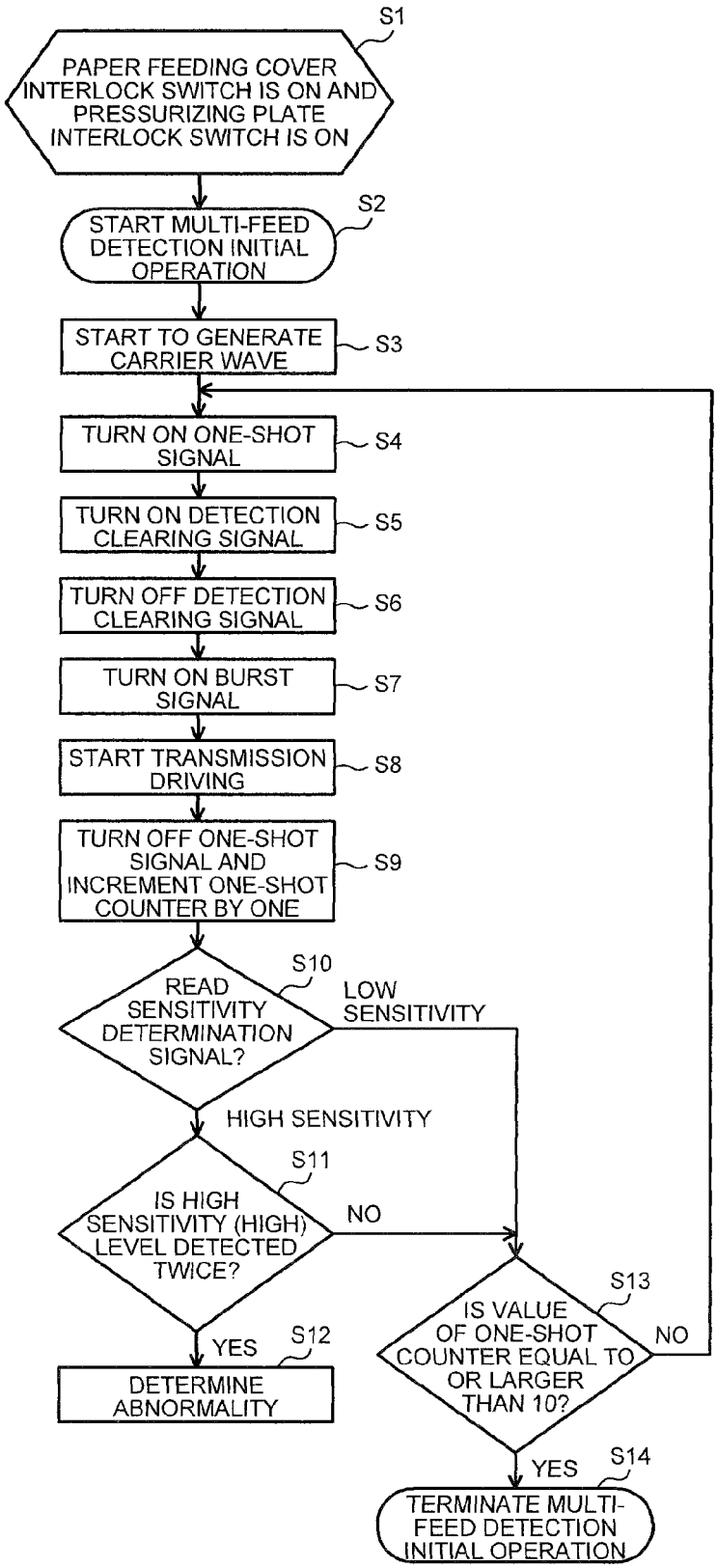
FIG. 15 is a flowchart of the multi-feed detection initial operation.

FIG. 15 is a flowchart of the multi-feed detection initial operation. The multi-feed detection initial operation is performed at a timing when the main power source of the copier 500 is turned ON and the ADF 51 starts to operate. Before the multi-feed detection initial operation is performed, it is checked whether the pressurizing plate interlock switch 525 and the paper feeding unit cover interlock switch 529 illustrated in FIG. 1 and FIG. 7 are ON (S1). With this operation, it is checked whether the ADF 51 is not opened with respect to the image forming unit 1 and whether the paper feeding unit cover 98 is not opened. After the check, the multi-feed detection initial operation is started (S2).

In the multi-feed detection initial operation, a "carrier signal" is generated (S3), and then an "one-shot signal" is generated (S4). At this time, a "detection clearing signal" generated with the combination of the "one-shot signal" is turned ON (S5). The "detection clearing signal" is generated at the timing when the "one-shot signal" is turned ON. The "detection clearing signal" is generated every time the "one-shot signal" is turned ON and is turned OFF after remaining in the ON state for a certain period of time (S6).

Subsequently, a "burst signal" generated (S7). When the "burst signal" is generated, a transmission driving signal for causing the transmission circuit board 630 to transmit an ultrasonic signal is generated, thereby causing the ultrasonic transmitting element 530 to transmit ultrasonic waves (S8). At a timing when the "one-shot signal" is turned OFF, the value of a "one-shot counter" is incremented by one (S9). After the increment, it is determined whether the multi-feed detecting mechanism 600 has abnormality using a "sensitivity determination signal" as a criterion at the timing Q2 when the main circuit board 610 determines whether a failure occurs (S10).

Because the determination is made using the "sensitivity determination signal", the determination is made based on whether the output of the signal is at a low sensitivity (low) level or a high sensitivity (high) level. If the output of the "sensitivity determination signal" is at the high sensitivity (high) level, the control contents described above are performed again (No at S11). If the high sensitivity (high) level is detected twice in the reading of the sensitivity determination signal (S10) (Yes at S11), abnormality is determined (S12). At the reading of the sensitivity determination signal (S10), if the output of the "sensitivity determination signal" is at the high sensitivity (low) level and the value of the "one-shot counter" is equal to or larger than "10" (Yes at S13), the multi-feed detection initial operation is terminated, and the processing is normally terminated (S14).

Table 1 indicates the states of abnormalities occurring in the multi-feed detecting mechanism 600 and detectability of the states of abnormalities in the multi-feed detection initial operation.

TABLE 1

| State of multi-feed detecting mechanism | Output result of sensitivity determination signal | Detectability in multi-feed detection initial operation |
|---|---|---|
| Normal state | Low sensitivity | — |
| Ultrasonic waves cannot be transmitted | Low sensitivity | Impossible |
| First multi-feed detection line (532) is unconnected | High sensitivity | Possible |
| Second multi-feed detection line (533) is unconnected | Low sensitivity | Impossible |
| Third multi-feed detection line (534) is unconnected | High sensitivity | Possible |
| Output of ultrasonic receiving element (531) is fixed at low level | Low sensitivity | Impossible |
| Output of ultrasonic receiving element (531) is fixed at high level | High sensitivity | Possible |

As illustrated in Table 1, the multi-feed detection initial operation according to the present embodiment can detect some of the abnormal states and cannot detect the others. The multi-feed detection initial operation can detect three abnormal states, where "the first multi-feed detection line 532 is unconnected", where "the third multi-feed detection line 534 is unconnected", and where "the output of the ultrasonic receiving element 531 is fixed at a high level". By contrast, the multi-feed detection initial operation cannot detect the three abnormal states, where "ultrasonic waves cannot be transmitted", where "the second multi-feed detection line 533 is unconnected", and where "the output of the ultrasonic receiving element 531 is fixed at a low level".

The three undetectable abnormal states described above are each detected as an occurrence of multi-feed when the user uses the ADF 51 after the multi-feed detection initial operation is finished. Thus, the user can find that a failure occurs. The present embodiment includes a multi-feed detection position document detecting unit (not illustrated) that detects the presence of the document MS at the multi-feed detection position. After the multi-feed detection initial operation is finished, control for checking the presence of the document MS in the document conveying path 54 including the multi-feed detection position is performed using internal document detecting units (e.g., 61, 65, 67, and 71) that detect the presence of the document MS at the respective positions in the document conveying path 54. If it is detected that the document MS is present in the document conveying path 54, by indicating on the display unit of the operating unit 108 that the document is present, it is possible to notify the user that the document MS is present in the document conveying path 54, thereby urging the user to remove the document MS.

The embodiment above is given by way of example, and the present invention has specific advantageous effects in each of the following aspects.

Aspect A

A sheet material conveying device, such as the ADF 51, includes a sheet material housing unit, a sheet material conveying unit, a separating/feeding unit, a multi-feed detecting unit, and an internal sheet material detecting unit. The sheet material housing unit, such as the document placing table 53, houses a plurality of sheet materials, such as documents MS, in a stacked manner. The sheet material conveying unit, such as the pair of pullout rollers 86, the pair of intermediate rollers 66, and the pair of scanning entrance rollers 90, conveys each of the sheet materials to a predetermined conveyance target position. The separating/feeding unit, such as the paper feeding belt 84 and the reverse roller 85, separates a sheet material from the sheet materials in the sheet material housing unit and conveys the separated sheet material alone to the sheet material conveying unit. The multi-feed detecting unit, such as the multi-feed detecting mechanism 600, detects whether multi-feed occurs in which a plurality of sheet materials are fed from the separating/feeding unit to the sheet material conveying unit. The internal sheet material detecting unit, such as the internal document detecting unit, detects the presence of a sheet material in the sheet material conveying unit. The sheet material conveying device performs multi-feed failure detection control, such as the multi-feed initial operation, for detecting whether a failure occurs in the multi-feed detecting unit.

As described in the embodiment above, according to this configuration, it is possible to detect at least some of failures occurring in the multi-feed detecting unit before notification of the detection result of the internal sheet material detecting unit. This is because of the following reason. Failures in the multi-feed detecting unit include failures that cannot be detected when the sheet material is present at the multi-feed detection position and failures that can be detected even when the sheet material is present at the multi-feed detection position. The failures that can be detected even when the sheet material is present at the multi-feed detection position can be detected regardless of the presence of the sheet material in the sheet material conveying unit. By performing the multi-feed failure detection control before notification of the detection result of the internal sheet material detecting unit, it is possible to detect at least the failures that can be detected even when the sheet material is present at the multi-feed detection position. According to this configuration, it is possible to detect at least some of the failures in the multi-feed detecting unit before notification of the detection result of the internal sheet material detecting unit and notify the user that the failure occurs in the multi-feed detecting unit. This makes it possible to notify, when a sheet material is present in the conveying path and a failure occurs in the multi-feed detecting unit, the user that the failure occurs in the multi-feed detecting unit before causing the user to expect conveyance of a sheet material to be enabled by removing the sheet material.

Aspect B

In Aspect A, the multi-feed failure detection control, such as the multi-feed initial operation, is performed before the internal sheet material detecting unit, such as the internal document detecting unit, performs control for detecting the presence of the sheet material, such as the document MS, in the sheet material conveying unit, such as the document conveying path 54.

As described in the embodiment above, according to this configuration, it is possible to notify the user of at least some of the failures in the multi-feed detecting unit before notification of the detection result of the internal sheet material detecting unit.

In the configuration that performs the multi-feed failure detection control after performing the control for detecting the presence of the sheet material in the sheet material conveying unit, the multi-feed failure detection control is performed before notification of the detection result even if the presence of the sheet material in the sheet material conveying unit is detected. If the multi-feed failure detection control detects that a failure occurs in the multi-feed detecting unit, control is performed such that the user is notified of the detection result before or at least at the same time when the user is notified of the detection result indicating that the sheet material is present in the sheet material conveying unit. This can prevent a situation contrary to the user's expectation that conveyance of a sheet material is to be enabled immediately by removing the sheet material from the sheet material conveying unit.

In the configuration that performs the multi-feed failure detection control after performing the control for detecting the presence of the sheet material in the sheet material conveying unit, the following control is performed. If it is detected that no sheet material is present at least at the multi-feed detection position, the subsequent multi-feed failure detection control can detect occurrences not only of the failures that cannot be detected when the sheet material is present at the multi-feed detection position but also of the failures that can be detected even when the sheet material is present at the multi-feed detection position. In the configuration that performs the multi-feed failure detection control after performing the control for detecting the presence of the sheet material in the sheet material conveying unit, the detection result of the presence of the sheet material can be reflected in the multi-feed failure detection control.

Aspect C

In any one of Aspect A and Aspect B, the multi-feed detecting unit includes an ultrasonic transmitting unit, an ultrasonic receiving unit, and a detection signal control unit. The ultrasonic transmitting unit, such as the transmission circuit board 630, and the ultrasonic receiving unit, such as the reception circuit board 640, face each other with a conveying path of the sheet material in the sheet material conveying unit, such as the document conveying path 54, interposed therebetween. The ultrasonic transmitting unit transmits ultrasonic waves, and the ultrasonic receiving unit receives the ultrasonic waves transmitted from the ultrasonic transmitting unit. The detection signal control unit, such as the main circuit board 610 and the multi-feed I/F circuit board 620, controls the ultrasonic transmitting unit and the ultrasonic receiving unit.

As described in the embodiment above, according to this configuration, it is possible to detect the failures that can be detected even when the sheet material is present at the multi-feed detection position between the ultrasonic transmitting unit and the ultrasonic receiving unit in the conveying path of the sheet material among the failures in the multi-feed detecting unit even when the sheet material is present in the conveying path. The failures in the multi-feed detecting unit include failures that cannot be detected when the sheet material is present at the multi-feed detection position and failures that can be detected even when the sheet material is present at the multi-feed detection position.

Examples of the failures that cannot be detected when the sheet material is present at the multi-feed detection position include a failure in the line from the detection signal control unit to the ultrasonic transmitting unit and a failure in the ultrasonic transmitting unit. To check whether these units operate normally, the following method may be performed. The ultrasonic transmitting unit performs control for transmitting ultrasonic waves at a predetermined output level, and the determination is made based on whether a reception signal of the ultrasonic receiving unit that receives the transmitted ultrasonic waves corresponds to a reception signal obtained when the ultrasonic transmitting unit receives ultrasonic waves at the predetermined output level. If a failure occurs in the line from the detection signal control unit to the ultrasonic transmitting unit or in the ultrasonic transmitting unit, the ultrasonic transmitting unit cannot transmit ultrasonic waves at the predetermined output level. As a result, the reception signal of the ultrasonic receiving unit does not correspond to that obtained when the ultrasonic receiving unit receives ultrasonic waves at the predetermined output level. Thus, it can be considered that some failure occurring in the multi-feed detecting unit is detected. When the sheet material is present at the multi-feed detection position, the ultrasonic waves transmitted from the ultrasonic transmitting unit are attenuated when passing through the sheet material. Even if the ultrasonic transmitting unit transmits the ultrasonic waves at the predetermined output level, the reception signal of the ultrasonic receiving unit does not correspond to that obtained when the ultrasonic receiving unit receives ultrasonic waves at the predetermined output level. Despite no failure occurring in the multi-feed detecting unit, it is detected that some failure occurs in the multi-feed detecting unit. Thus, a failure in the line from the detection signal control unit to the ultrasonic transmitting unit or in the ultrasonic transmitting unit cannot be detected when the sheet material is present at the multi-feed detection position.

By contrast, examples of the failures that can be detected even when the sheet material is present at the multi-feed detection position include a failure in the line between the ultrasonic receiving unit and the detection signal control unit. Even when no ultrasonic wave is received or when the output of the received ultrasonic waves is small, the ultrasonic receiving unit generates a reception signal for communicating to the detection signal control unit that no ultrasonic wave is received or that the output of the received ultrasonic waves is small. Thus, even when the ultrasonic waves transmitted from the ultrasonic transmitting unit are attenuated by the sheet material or when no ultrasonic wave is transmitted from the ultrasonic transmitting unit, the ultrasonic receiving unit generates some reception signal. The generated reception signal is then transmitted to the detection signal control unit. If a failure occurs in the line between the ultrasonic receiving unit and the detection signal control unit in this configuration, the reception signal is not transmitted to the detection signal control unit. As a result, no reception signal is transmitted to the detection signal control unit at a timing when a reception signal is supposed to be transmitted to the detection signal control unit. Thus, it is detected that some failure occurs in the line between the ultrasonic receiving unit and the detection signal control unit. At this time, if a failure occurs in the line, no reception signal is transmitted to the detection signal control unit regardless of the presence of the sheet material at the multi-feed detection position; whereas if no failure occurs in the line, a reception signal is transmitted to the detection signal control unit. Thus, a failure in the line between the ultrasonic receiving unit and the detection signal control unit can be detected even when the sheet material is present at the multi-feed detection position. Some failures in the multi-feed detecting unit cannot be detected when the sheet material is present at the multi-feed detection position.

The conventional technique uniformly performs multi-feed failure detection control for detecting a failure in a multi-feed detecting unit only when no sheet material is present at a multi-feed detection position. With this configuration, however, even if only a failure occurs that can be detected even when the sheet material is present at the multi-feed detection position, the user is first notified that a sheet material is present at the multi-feed detection position when the sheet material is present at the multi-feed detection position. Although the user expects scanning of a document to be enabled immediately by removing the sheet material, the user needs to ask a service person to come after performing the operation to remove the sheet material. By contrast, by performing the multi-feed failure detection control before notification of the detection result of the internal sheet material detecting unit, the failure in the multi-feed detecting unit can be detected even if the operation to remove the sheet material is not performed in a case where only a failure occurs that can be detected even when the sheet material is present at the multi-feed detection position. This makes it possible to notify the user that the failure occurs in the multi-feed detecting unit even when the sheet material is present in the conveying path.

Aspect D

In Aspect C, the ultrasonic receiving unit, such as the reception circuit board 640, includes an ultrasonic receiving element, a multi-feed determining unit, and a reception sensitivity determination circuit. The ultrasonic receiving element, such as the ultrasonic receiving element 531, outputs a reception signal having a value varying depending on the magnitude of the received ultrasonic waves. The multi-feed determining unit, such as the multi-feed determination circuit 643, determines whether multi-feed occurs based on the reception signal. The reception sensitivity determination circuit, such as the sensitivity determination circuit 642, is provided separately from the multi-feed determining unit and determines the reception sensitivity of the ultrasonic receiving element based on whether the reception signal is higher than a predetermined threshold. In the multi-feed failure detection control, such as the multi-feed detection initial operation, occurrence of a failure in the multi-feed detecting unit, such as the multi-feed detecting mechanism 600, is detected using the determination result of the reception sensitivity determination circuit.

As described in the embodiment above, according to this configuration, it is possible to perform the multi-feed failure detection control without using a signal output from the multi-feed determining unit.

Aspect E

An image scanning device, such as the image scanning unit 50, includes a document conveying unit and a conveyed document scanning unit. The document conveying unit conveys a document sheet, such as the document MS, serving as the sheet material. The conveyed document scanning unit, such as the scanner 150, scans a document image of the document sheet conveyed by the document conveying unit. The image scanning device includes the sheet material conveying device according to any one of Aspects A to D, such as the ADF 51, as the document conveying unit.

As described in the embodiment above, according to this configuration, it is possible to notify the user that a failure occurs in the multi-feed detecting unit even when the document sheet is present in the conveying path in the sheet material conveying device serving as the document conveying unit. This can provide the image scanning device that prevents a situation contrary to the user's expectation that scanning of a sheet material is to be enabled simply by removing the document sheet when both a jam of the document sheet and a failure in the multi-feed detecting unit occur.

Aspect F

An image forming apparatus, such as the copier 500, includes an image scanning unit and an image forming unit, such as the image forming unit 1, that forms an image based on the document image scanned by the image scanning unit. The image forming apparatus includes the image scanning device according to Aspect E as the image scanning unit.

As described in the embodiment above, according to this configuration, it is possible to notify the user that a failure occurs in the multi-feed detecting unit even when the document sheet is present in the conveying path in the sheet material conveying device serving as the document conveying unit. This can provide the image forming apparatus that prevents a situation contrary to the user's expectation that formation of an image based on the document image is to be enabled simply by removing the document sheet when both a jam of the document sheet and a failure in the multi-feed detecting unit occur.

According to an embodiment, it is possible to notify, when a sheet material is present in a conveying path and a failure occurs in a multi-feed detecting unit, a user that the failure occurs in the multi-feed detecting unit before causing the user to expect conveyance of a sheet material to be enabled simply by removing the sheet material.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet material conveying device comprising:

a sheet material housing unit that houses a plurality of sheet materials in a stacked manner;

a sheet material conveying unit that conveys each of the sheet materials to a predetermined conveyance target position;

a separating/feeding unit that separates a sheet material from the sheet materials in the sheet material housing unit and conveys the separated sheet material alone to the sheet material conveying unit;

a multi-feed detecting unit that detects whether multi-feed occurs at a multi-feed detecting position, in which a plurality of sheet materials are fed from the separating/feeding unit to the sheet material conveying unit; and an internal sheet material detecting unit that detects presence of the sheet material in the sheet material conveying unit, wherein the sheet material conveying device includes a controller configured to performed multi-feed failure detection control, wherein the controller detects a failure of the multi-feed detecting unit while sheet materials are present at the multi-feed detecting position and while sheet materials are not present at the multi-feed detecting position, before obtaining a detection result of the internal sheet material detecting unit.

2. The sheet material conveying device according to claim 1, wherein the multi-feed failure detection control is performed before the internal sheet material detecting unit performs control for detecting the presence of the sheet material in the sheet material conveying unit.

3. The sheet material conveying device according to claim 1, wherein the multi-feed detecting unit includes an ultrasonic transmitting unit that transmits ultrasonic waves, an ultrasonic receiving unit that receives the ultrasonic waves transmitted from the ultrasonic transmitting unit, and a detection signal control unit that controls the ultrasonic transmitting unit and the ultrasonic receiving unit, the ultrasonic transmitting unit and the ultrasonic receiving unit facing each other with a conveying path of the sheet material in the sheet material conveying unit interposed therebetween.

4. The sheet material conveying device according to claim 3, wherein the ultrasonic receiving unit includes an ultrasonic receiving element that outputs a reception signal having a value varying depending on magnitude of the received ultrasonic waves, a multi-feed determining unit that determines whether multi-feed occurs based on the reception signal, and a reception sensitivity determination circuit that is provided separately from the multi-feed determining unit and determines reception sensitivity of the ultrasonic receiving element based on whether the reception signal is higher than a predetermined threshold, and in the multi-feed failure detection control, occurrence of a failure in the multi-feed detecting unit is detected using a determination result of the reception sensitivity determination circuit.

5. An image scanning device comprising:

a document conveying unit that conveys a document sheet serving as a sheet material; and a conveyed document scanning unit that scans a document image of the document sheet conveyed by the document conveying unit, wherein the sheet material conveying device according to claim 1 is used as the document conveying unit.

6. An image forming apparatus comprising:

an image scanning unit; and an image forming unit that forms an image based on a document image scanned by the image scanning unit, wherein the image scanning device according to claim 5 is used as the image scanning unit.

7. The sheet material conveying device according to claim 1, wherein the controller is further configured to control displaying, on a display device, a detected failure of the multi-feed detecting unit when sheet material is detected in a conveying path of the sheet material conveying device.

8. The sheet material conveying device according to claim 1, wherein the multi-feed detecting unit is downstream from the sheet material conveying unit.

* * * * *